US008391761B2

(12) United States Patent
Mitsuoka et al.

(10) Patent No.: US 8,391,761 B2
(45) Date of Patent: Mar. 5, 2013

(54) FIXING DEVICE AND IMAGE FORMING APPARATUS INCLUDING FIXING DEVICE

(75) Inventors: Tetsunori Mitsuoka, Osaka (JP); Akihiko Taniguchi, Osaka (JP); Hiroyuki Kageyama, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 415 days.

(21) Appl. No.: 12/779,163

(22) Filed: May 13, 2010

(65) Prior Publication Data

US 2010/0303525 A1 Dec. 2, 2010

(30) Foreign Application Priority Data

May 26, 2009 (JP) ..... 2009-127065

(51) Int. Cl.
*G03G 15/20* (2006.01)

(52) U.S. Cl. ..... 399/329; 219/216; 399/33; 399/69; 399/334

(58) Field of Classification Search ..... 399/33, 399/69, 329, 334; 219/216
See application file for complete search history.

(56) References Cited

U.S. PATENT DOCUMENTS

| | | | | |
|---|---|---|---|---|
| 4,541,708 | A * | 9/1985 | Shigenobu | 399/33 |
| 6,091,059 | A * | 7/2000 | Sato et al. | 219/216 X |
| 6,243,559 | B1 | 6/2001 | Kurotaka et al. | 399/329 |
| 7,792,445 | B2 * | 9/2010 | Sone et al. | 399/33 X |
| 2005/0276624 | A1 | 12/2005 | Fujino | 399/69 |
| 2006/0210288 | A1 | 9/2006 | Hayashi et al. | 399/33 |
| 2007/0098418 | A1 * | 5/2007 | Kang et al. | 399/33 |
| 2007/0134018 | A1 * | 6/2007 | Nanba et al. | 399/69 |
| 2007/0212134 | A1 * | 9/2007 | Aoki | 399/329 |
| 2008/0219724 | A1 * | 9/2008 | Lee et al. | 399/329 |
| 2009/0226202 | A1 * | 9/2009 | Kinouchi et al. | 399/69 |
| 2009/0263171 | A1 * | 10/2009 | Kageyama | 399/329 |

FOREIGN PATENT DOCUMENTS

| | | | |
|---|---|---|---|
| JP | 07-261583 | A | 10/1995 |
| JP | 10-307496 | A | 11/1998 |
| JP | 2002-333788 | A | 11/2002 |
| JP | 2003-280413 | A | 10/2003 |
| JP | 2005-352389 | A | 12/2005 |
| JP | 2006-259330 | A | 9/2006 |
| JP | 2006-293051 | A | 10/2006 |
| JP | 2008-287030 | A | 11/2008 |

OTHER PUBLICATIONS

Machine translation of JP 2006-293051 A dated Aug. 26, 2012.*

* cited by examiner

*Primary Examiner* — Sophia S Chen
(74) *Attorney, Agent, or Firm* — Renner, Otto, Boisselle & Sklar, LLP

(57) ABSTRACT

A fixing device of belt fixing type is provided. A heat generating member that is a heat generating source for heating a fixing belt has a heat generating layer composed of a resistance heat generating element that generates heat due to being energized. The resistance heat generating element includes a paper passing region heating section and a detecting section provided on an end portion in an axial direction of the heat generating member and electrically connected in parallel with the paper passing region heating section. Furthermore, in a vicinity of the detecting section, an overheat preventing element that suppresses energization to the resistance heat generating element when temperature of the detecting section reaches a predetermined value, is provided.

15 Claims, 13 Drawing Sheets

21

25
214
210
211
216
213
217
212
215
218

221
301
212
301b
221
301a

FIXING DEVICE AND IMAGE FORMING APPARATUS INCLUDING FIXING DEVICE

CROSS-REFERENCE TO RELATED APPLICATION

This application claims priority to Japanese Patent Application No. 2009-127065, which was filed on May 26, 2009, the contents of which are incorporated herein by reference in its entirety.

BACKGROUND OF THE INVENTION

1. Field of the Invention

The present invention relates to a fixing device that fixes a toner image onto a recording medium by an action of heat and pressure, and to an image forming apparatus including the fixing device.

2. Description of the Related Art

As a fixing device for use in an electrophotographic image forming apparatus such as a copying machine and a printer, a fixing device of heat-roller fixing type has been in wide use. The fixing device of heat-roller fixing type includes a pair of rollers (a fixing roller and a pressure roller) that are brought into contact with each other under pressure. By means of a heating section composed for example of a halogen lamp, which is placed in each of or one of the pair of rollers interiorly thereof, the pair of rollers are heated to a predetermined temperature (a fixing temperature). With the pair of rollers kept in a heated state, such as a recording paper sheet, which is a recording medium having formed thereon an unfixed toner image, is fed to a region where the pair of rollers make pressure-contact with each other (a fixing nip region). Upon the recording paper sheet passing through the pressure-contact region, the toner image is fixed to the recording paper sheet under application of heat and pressure.

Incidentally, a fixing device for use in a color image forming apparatus generally employs an elastic roller constructed by forming an elastic layer made for example of silicone rubber on a surface layer of the fixing roller. By designing the fixing roller as an elastic roller, it is possible for the surface of the fixing roller to become elastically deformed so as to conform to irregularities of the unfixed toner image, wherefore the fixing roller makes contact with the toner image so as to cover the surface of the toner image. This makes it possible to perform satisfactory thermal fixing on the unfixed color toner image that is larger in toner adherent amount than a monochromatic toner image. Moreover, by virtue of a deflection-releasing effect exerted by the elastic layer in the fixing nip region, it is possible to provide enhanced releasability for a color toner that is more susceptible to occurrence of offset than a monochromatic toner. Further, since the fixing nip region is convexly curved in a radially-outward direction so as to define a so-called reverse nip configuration, it is possible to attain higher paper-stripping capability. That is, a paper stripping action can be produced without using a stripping portion such as a stripping pawl (self-stripping action), wherefore image imperfection caused by the provision of the stripping portion can be eliminated.

Incidentally, in such a fixing device provided in a color image forming apparatus, it is necessary to make a nip width of the fixing nip region wide in order to correspond to increase in speed. One available method of increasing the fixing nip width is to increase the thickness of the elastic layer of the fixing roller and the diameter of the fixing roller. However, in a fixing roller having an elastic layer, the elastic layer can not sufficiently conduct heat, thus, in a case where a heating section is provided inside the fixing roller, there is a problem that a temperature of the fixing roller is not followed when a process speed is increased. On the other hand, when a diameter of the fixing roller is increased, there is a problem that it takes longer time to warm up or power consumption is increased.

As a fixing device provided in a color image forming apparatus to solve such problems, Japanese Unexamined Patent Publication JP-A 10-307496 (1998) discloses a fixing device of belt fixing type that is configured so that a fixing belt is supported around a fixing roller and a heating roller, and the fixing roller and a pressure roller are brought into pressure-contact with each other with the fixing belt interposed therebetween. In the fixing device of belt fixing type, since the fixing belt with a small heat capacity is heated, it takes short time to warm up and it is not necessary to incorporate a heat source such as a halogen lamp in the fixing roller, thus making it possible to provide a thick elastic layer with low hardness made of sponge rubber and the like and to secure a wide nip width.

Furthermore, JP-A 2002-333788 discloses a fixing device of planar heat generating belt fixing type with a heating section as a planar heat generating element. In the fixing device of planar heat generating belt fixing type, when a heat capacity of the heating section is reduced, the planar heat generating element as the heating section directly generates heat at the same time, thus a thermal response speed is also enhanced compared to a system in which a heating roller is heated indirectly using a halogen lamp or the like and it is possible to attain further shortening of a time for warm up and more energy saving.

When the planar heat generating element composed of a resistance heat generating element including a metal and an inorganic substance is separated or risen from a substrate, there is a possibility that the planar heat generating element becomes an overheated state and results in smoke generation or burnout. Therefore, in the fixing device of planar heat generating belt fixing type, temperature abnormality under which the planar heat generating element becomes the overheated state is detected by an overheat preventing element (thermostat, thermal fuse, thermal protector, or the like), energization to the planar heat generating element is cut off based on the detection result, and thereby it is possible to prevent that the planar heat generating element becomes the overheated state and results in smoke generation or burnout.

In the fixing device of belt fixing type using the planar heat generating element of high power density, since the temperature rising speed of the planar heat generating element is high, in order to prevent that the planar heat generating element becomes the overheated state and results in smoke generation or burnout, the temperature abnormality under which the planar heat generating element becomes the overheated state should be detected earlier. In order to detect earlier the temperature abnormality under which the planar heat generating element becomes the overheated state, the overheat preventing element may be arranged to be in contact with the fixing belt or the planar heat generating element, however, in such a case, there is a possibility that not only a defect occurs in the fixed image on recording paper, but also temperature distribution on the surface of the fixing belt becomes non-uniform. Furthermore, when the overheat preventing element is arranged to be in contact with the fixing belt or the planar heat generating element, there is a possibility that detection sensitivity of the overheat preventing element becomes poor and thereby the thermal abnormality itself is not possible to be detected.

Moreover, in the fixing device of planar heat generating belt fixing type, a width of a paper non-passing region on the fixing belt surface varies depending on a size of the recording paper to be supplied to the fixing nip region. In the paper non-passing region that the recording paper does not contact on the surface of the fixing belt, since heat generated from the planar heat generating element will not be taken by the recording paper, a regional part of the planar heat generating element corresponding to the paper non-passing region becomes an excessive temperature rising state. In this way, when the planar heat generating element becomes the excessive temperature rising state regionally corresponding to the paper non-passing region, there is a case where the overheat preventing element that detects overheated state of the planar heat generating element operates erroneously.

To solve the above problem, Japanese Unexamined Patent Publication JP-A 2003-280413 discloses a heating device composed of a resistance heat generating element that generates heat due to being energized, including a paper passing portion corresponding to a paper passing region of recording paper and a paper non-passing portion which is a region part other than the paper passing portion and to which a thermo-protector (overheat preventing element) is arranged in a vicinity thereof, and the paper passing portion and the paper non-passing portion are electrically connected in series.

In a case where the heating apparatus disclosed in JP-A 2003-280413 is used as a heating section that heats the fixing belt in the fixing device of belt fixing type, overheated state of the paper passing portion is indirectly detected by temperature change in the paper non-passing portion of the resistance heat generating element due to energization, when the temperature in the paper non-passing portion reaches a predetermined temperature, it is possible that the thermo-protector cuts off the energization. That is, by using the heating apparatus disclosed in JP-A 2003-280413 as a heating section that heats the fixing belt, irrespective of the size of the recording paper to be supplied to the fixing nip region, the overheated state of the paper passing portion is able to be indirectly detected by the temperature change in the paper non-passing portion of the resistance heat generating element corresponding to the paper non-passing region that the recording paper does not contact all the time, it is possible to prevent that the overheat preventing element operates erroneously.

However, in the heating apparatus disclosed in JP-A 2003-280413, it is configured that the paper passing portion and the paper non-passing portion of the resistance heat generating element that generates heat due to being energized are electrically connected in series, when power of the paper passing portion and the paper non-passing portion is set to be the same, power density of the paper non-passing portion is smaller than that of the paper passing portion, and the temperature rinsing speed of the paper non-passing portion due to energization becomes slower than that of the paper passing portion. Therefore, even in the case where the temperature of the paper passing portion is risen to be the overheated state due to energization, the temperature of the paper non-passing portion shows a lower value than the paper passing portion, and thereby the overheat preventing element arranged in the vicinity of the paper non-passing portion is incapable of indirectly detecting the overheated state of the paper passing portion accurately from the temperature change in the paper non-passing portion due to energization. Furthermore, in the configuration where the paper passing portion and the paper non-passing portion are electrically connected in series, when the power density of the paper passing portion and the paper non-passing portion are set to be the same, the power of the paper non-passing portion is smaller than that of the paper passing portion, and thereby the overheat preventing element arranged in the vicinity of the paper non-passing portion is incapable of indirectly detecting the overheated state of the paper passing portion accurately from the temperature change in the paper non-passing portion due to energization.

Moreover, the configuration in which the paper passing portion and the paper non-passing portion are electrically connected in series is susceptible to a disturbance factor such as variation in applied voltage to the respective portions, and thus the temperature change in the respective portions is not the same, thus it is impossible to indirectly detect the overheated state of the paper passing portion accurately from the temperature change in the paper non-passing portion due to energization.

SUMMARY OF THE INVENTION

Hence, an object of the invention is to provide a fixing device of belt fixing type configured to heat a fixing belt by using heat of a resistance heat generating element that generates heat due to being energized, in which temperature abnormality under which the resistance heat generating element becomes an overheated state is able to be detected by an overheat preventing element accurately in a state where an erroneous operation is prevented, the resistance heat generating element becoming the overheated state and resulting in smoke generation or burnout is prevented, and high safety is able to be secured, and to provide an image forming apparatus including the fixing device.

The invention provides a fixing device comprising:

a first fixing member;

a heating member;

a fixing belt that forms an endless-shaped belt member supported around the first fixing member and the heating member with tension to be rotatable, and comes into contact with the heating member to be heated; and a second fixing member that forms a fixing nip region together with the fixing belt, the fixing device fixing a toner image borne on a recording medium onto the recording medium in the fixing nip region under application of heat and pressure, the heating member including:

a curved heat radiating member having an outer circumferential surface in contact with the fixing belt; and a heat generating member having a heat generating layer composed of a resistance heat generating element that generates heat due to being energized and arranged to be in contact with an inside surface of the heat radiating member, the resistance heat generating element including:

a paper passing region heating section forming a heat generating source part for heating a paper passing region of the fixing belt where the recording medium contacts and passes in the fixing nip region; and a detecting section that is provided to correspond to a paper non-contacting region of the recording medium of the fixing belt and connected electrically in parallel with the paper passing region heating section, and the fixing device further comprising an overheat preventing element that is provided in a vicinity of the detecting section and suppresses energization to the resistance heat generating element when temperature of the detecting section reaches a predetermined value.

According to the invention, in the fixing device, a heating member that heats a fixing belt includes a curved heat radiating member having an outer circumferential surface in contact with the fixing belt, and a heat generating member arranged to be in contact with an inside surface of the heat radiating member. The heat generating member has a heat generating layer composed of a resistance heat generating element that generates heat due to being energized. Then the resistance heat generating element includes a paper passing region heating section forming a heat generating source part for heating a paper passing region of the fixing belt and a detecting section that is provided to correspond to a paper non-contacting region of the recording medium of the fixing belt and connected electrically in parallel with the paper passing region heating section. Moreover, in a vicinity of the detecting section of the resistance heat generating element, an overheat preventing element that suppresses energization to the resistance heat generating element when temperature of the detecting section reaches a predetermined value, is provided.

In the fixing device, since it is configured that energization to the resistance heat generating element is controlled by an overheat preventing element provided in the vicinity of the detecting section arranged on an end portion of the axial direction of the heat generating member corresponding to the non-contacting region of the recording medium of the fixing belt, irrespective of the size of the recording medium supplied to the fixing nip region, it is possible to indirectly detect an overheated state of the paper passing region from the temperature change in the detecting section corresponding to the paper non-passing region of the fixing belt that the recording medium does not contact all the time, and thereby an erroneous operation of the overheat preventing element is able to be prevented.

Further, since the paper passing region heating section and the detecting section are electrically connected in parallel, the resistance heat generating element that generates heat due to being energized is prevented from being subjected to a disturbance factor such as variation in applied voltage to the paper passing region heating section and the detecting section. Therefore, when the resistance heat generating element is energized, the temperature changes in the paper passing region and the detecting section are the same, and the overheated state of the paper passing region heating section is able to be indirectly detected accurately from the temperature change in the detecting section due to energization. Accordingly, it is possible to prevent that the paper passing region heating section of the resistance heat generating element becomes an overheated state and results in smoke generation or burnout, and high safety is able to be secured.

Further, in the invention, it is preferable that the paper passing region heating section and the detecting section have an equivalent power density.

According to the invention, in the resistance heat generating element that generates heat due to being energized, the paper passing region heating section and the detecting section have an equivalent power density. Whereby, when the resistance heat generating element is energized, the temperature changes in the paper passing region heating section and the detecting section are the same, and the overheated state of the paper passing region heating section is able to be indirectly detected accurately from the temperature change in the detecting section due to energization.

Further, in the invention, it is preferable that the paper passing region heating section and the detecting section have an equivalent temperature rising speed in generating heat due to being energized.

According to the invention, in the resistance heat generating element that generates heat due to being energized, the paper passing region heating section and the detecting section have an equivalent temperature rising speed in generating heat due to being energized. Whereby, when the resistance heat generating element is energized, the temperature changes in the paper passing region heating section and the detecting section are the same, and the overheated state of the paper passing region heating section is able to be indirectly detected accurately from the temperature change in the detecting section due to energization.

Further, in the invention, it is preferable that the paper passing region heating section and the detecting section have an equivalent specific heat capacity.

According to the invention, in the resistance heat generating element that generates heat due to being energized, the paper passing region heating section and the detecting section have an equivalent specific heat capacity. Whereby, when the resistance heat generating element is energized, the temperature changes in the paper passing region heating section and the detecting section are the same, and the overheated state of the paper passing region heating section is able to be indirectly detected accurately from the temperature change in the detecting section due to energization.

Further, in the invention, it is preferable that the resistance heat generating element is configured to form a surface of a fixed shape as a whole.

According to the invention, the resistance heat generating element is configured to form a surface of a fixed shape as a whole. Whereby, efficiency of heat transfer in transmitting the heat of the resistance heat generating element generated due to energization to the heat radiating member, is able to be improved.

Further, in the invention, it is preferable that the resistance heating element is a ceramic heating element.

According to the invention, with this configuration, the resistance heating element is a ceramic heating element. The ceramic heating element is a heating element that can realize high power density. Therefore, the heat generating member including the ceramic heating element has high heating capability with respect to the heat radiating member.

Further, in the invention, it is preferable that the resistance heating element has a positive resistance-temperature property in which, as temperature rises, electrical resistance increases.

According to the invention, the resistance heat generating element has a positive resistance-temperature property. In the resistance heat generating element having the positive resistance-temperature property, electrical resistance increases as temperature rises. In such a resistance heat generating element having the positive resistance-temperature property, when the temperature thereof becomes a predetermined temperature or more, the electrical resistance sharply increases and the current value becomes small, thereby it is prevented to be the overheated state. Moreover, in the resistance heat generating element having the positive resistance-temperature property, since the current value becomes small as the temperature rises, amount of power consumption is able to be reduced and the energy saving is able to be realized. Moreover, since the resistance heat generating element has the paper passing region heating section and the detecting section, even though the resistance heat generating element is the heat generating element having the positive resistance-temperature property, it is possible to indirectly detect the overheated state of the paper passing region heating section accurately from the temperature change in the detecting section due to energization.

Further, in the invention, it is preferable that the resistance heating element has a negative resistance-temperature property in which, as temperature rises, electrical resistance decreases.

According to the invention, the resistance heat generating element has a negative resistance-temperature property. In the resistance heat generating element having the negative resistance-temperature property, electrical resistance decreases as temperature rises. Here, since the resistance heat generating element has the paper passing region heating section and the detecting section, even in the case where the resistance heat generating element is the heat generating element having the negative resistance-temperature property, it is possible to indirectly detect the overheated state of the paper passing region heating section accurately from the temperature change in the detecting section due to energization.

Further, in the invention, it is preferable that the resistance heating element has a positive resistance-temperature property and a negative resistance-temperature property.

According to the invention, the resistance heat generating element has a positive resistance-temperature property and a negative resistance-temperature property. Here, since the resistance heat generating element has the paper passing region heating section and the detecting section, even in the case where the resistance heat generating element is the heat generating element having the positive resistance-temperature property and the negative resistance-temperature property, it is possible to indirectly detect the overheated state of the paper passing region heating section accurately from the temperature change in the detecting section due to energization.

Further, in the invention, it is preferable that the heat generating member has a heat generating layer composed of a plurality of the resistance heat generating elements, and is configured such that a heat generating part that generates heat due to being energized is divided into more than one, each of the plurality of resistance heat generating elements has the paper passing region heating section and the detecting section.

According to the invention, the heat generating member is configured to have a heat generating layer composed of the plurality of resistance heat generating elements, and the heat generating part thereof which generates heat due to being energized is divided into more than one. Whereby, on/off of energization is switched for the respective resistance heat generating elements that correspond to the respective divisions of the heat generating part, and it is possible to adjust the temperature distribution on the surface of the heat radiating member in contact with the fixing belt to be desired temperature distribution. For example, in such as a case where a toner image is fixed by supplying recording medium of a different dimension, width, or thickness to the fixing nip region, by switching on/off of energization so that only the resistance heat generating element corresponding to a desired specific region on the surface of the heat radiating member generates heat, in accordance with the different size (dimension, width, or thickness) of the recording medium, the surface of the heat radiating member is able to have the desired temperature distribution. Whereby, the regional abnormal temperature rise of the resistance heat generating element corresponding to a non-contacting part of the recording medium on the surface of the fixing belt is able to be suppressed.

Further, each of the plurality of resistance heat generating elements has the paper passing region heating section and the detecting section. Whereby, the overheated state of the paper passing region heating section is able to be indirectly detected accurately from the temperature change in the detecting section due to energization, for the respective resistance heat generating elements that correspond to the respective divisions of the heat generating part. Accordingly, it is possible to prevent the paper passing region of each of the resistance heat generating elements becomes overheated state and results in smoke generating or burnout, and high safety is able to be secured.

Further, in the invention, it is preferable that the second fixing member includes a pressure belt that is an endless-shape belt member supported around a pressure member and a supporting member with tension so as to be rotatable, and the pressure member is provided to face the first fixing member with the fixing belt and the pressure belt interposed therebetween.

According to the invention, the second fixing member includes a pressure belt that is an endless-shape belt member supported around a pressure member and a supporting member with tension so as to be rotatable. Then the pressure member is provided to face the first fixing member with the fixing belt and the pressure belt interposed therebetween, and a fixing nip region is formed at a part where the fixing belt contacts the pressure belt. Thereby, a wide fixing nip region is able to be obtained without enlarging an apparatus, and fixing failure is able to be suppressed.

Further, the invention provides a fixing device of two-stage fixing type, comprising:

a first fixing section that performs primary fixing of a toner image borne on a recording medium to be conveyed onto the recording medium under application of heat and pressure; and a second fixing section that is arranged on a downstream side of a conveyance direction of the recording medium with respect to the first fixing section, and performs secondary fixing of the toner image after the primary fixing onto the recording medium under application of heat and pressure, the first fixing section and the second fixing section being the fixing device mentioned above.

According to the invention, a fixing device of two-stage fixing type comprises a first fixing section that performs primary fixing of a toner image borne on recording medium to be conveyed onto the recording medium under application of heat and pressure, and a second fixing section that is arranged on a downstream side of a conveyance direction of the recording medium with respect to the first fixing section, and performs secondary fixing of the toner image after the primary fixing onto the recording medium under application of heat and pressure. Then the first fixing section and the second fixing section are the fixing device mentioned above provided with the resistance heat generating element in which the paper passing region heating section and the detecting section are electrically connected in parallel. In the fixing device of two-stage fixing type thus configured, when the respective resistance heat generating elements provided in the first fixing section and the second fixing section are energized, temperature changes in the paper passing region heating section and the detecting section of the respective resistance heat generating elements are the same. Therefore, in each resistance heat generating element that is provided in the first fixing section and the second fixing section, the overheated state of the paper passing region heating section is able to be indirectly detected accurately from the temperature change in the detecting section due to energization.

Accordingly, it is possible to prevent the paper passing region heating section of the respective resistance heat generating elements provided in the first fixing section and the second fixing section from being overheated and generating smoke or burning out, and to secure high safety.

Further, the invention provides a fixing device of two-stage fixing type, comprising:

a first fixing section that performs primary fixing of a toner image borne on a recording medium to be conveyed onto the recording medium under application of heat and pressure; and a second fixing section that performs secondary fixing of the toner image after the primary fixing onto the recording medium under application of heat and pressure, the second fixing section being configured by a pair of heating and pressure rollers that are provided with a heating section in an interior thereof, and are in pressure-contact with each other, and being arranged on a downstream side of a conveyance direction of the recording medium with respect to the first fixing section, and the first fixing section being the fixing device mentioned above.

According to the invention, a fixing device of two-stage fixing type comprises a first fixing section that performs fixing of a toner image borne on recording medium to be conveyed onto the recording medium under application of heat and pressure, a second fixing section that performs secondary fixing of the toner image after the primary fixing onto the recording medium under application of heat and pressure, the second fixing section being configured by a pair of heating and pressure roller that are provided with a heating section in an interior thereof, and are in pressure-contact with each other, and being arranged on a downstream side of a conveyance direction of the recording medium with respect to the first fixing section. Then the first fixing section is the fixing device provided with the resistance heat generating element in which the paper passing region heating section and the detecting section are electrically connected in parallel. In the fixing device of two-stage fixing type thus configured, when the resistance heat generating element provided in the first fixing section is energized, temperature changes in the paper passing region heating section and the detecting section of the resistance heat generating element are the same.

Therefore, in the resistance heat generating element provided in the first fixing section, the overheated state of the paper passing region heating section is able to be indirectly detected accurately from the temperature change in the detecting section due to energization.

Accordingly, it is possible to prevent the paper passing region heating section of the resistance heat generating element provided in the first fixing section becomes an overheated state and results in smoke generation or burnout, and high safety is able to be secured.

Further, the invention provides an image forming apparatus including the fixing device mentioned above.

According to the invention, the image forming apparatus includes the fixing device capable of preventing the paper passing region heating section of the resistance heat generating element from becoming an overheated state and resulting in smoke generation or burnout, and securing high safety. Therefore, the image forming apparatus is capable of forming an image in a state where the high safety is secured over a long term.

BRIEF DESCRIPTION OF DRAWINGS

Other and further objects, features, and advantages of the invention will be more explicit from the following detailed description taken with reference to the drawings wherein.

DETAILED DESCRIPTION

Figure 1:
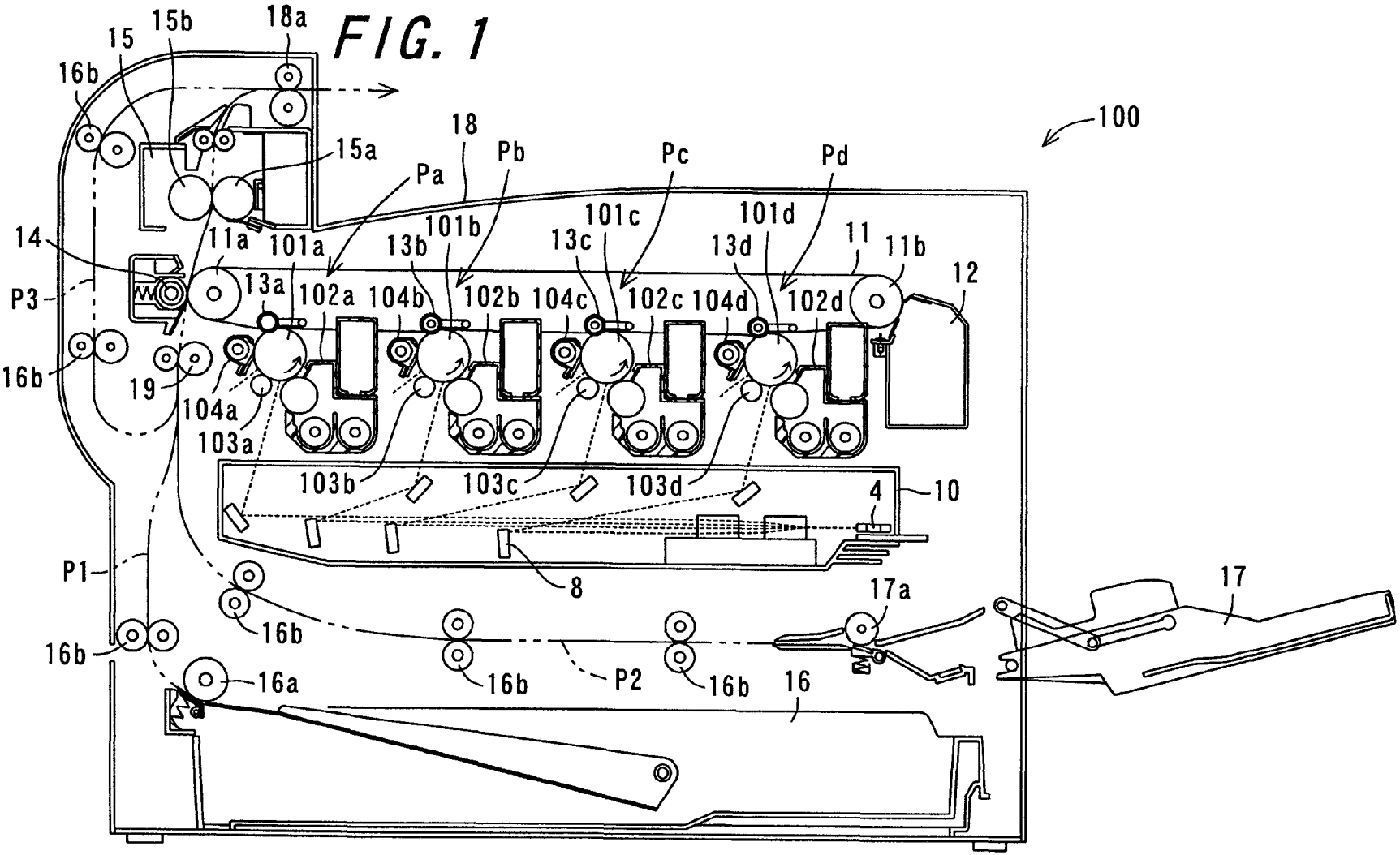
FIG. 1 is a view showing a structure of an image forming apparatus according to an embodiment of the invention.

Now referring to the drawings, preferred embodiments of the invention are described below.

FIG. 1 is a view showing the structure of an image forming apparatus 100 according to an embodiment of the invention. The image forming apparatus 100 is an apparatus that forms a color or monochrome image on a recording paper sheet based on image data read from a document or on image data transmitted through a network and the like. The image forming apparatus 100 includes an exposure unit 10, photoreceptor drums 101 (101*a* to 101*d*), developing devices 102 (102*a* to 102*d*), charging rollers 103 (103*a* to 103*d*), cleaning units 104 (104*a* to 104*d*), an intermediate transfer belt 11, primary transfer rollers 13 (13*a* to 13*d*), a secondary transfer roller 14, a fixing device 15, paper conveyance paths P1, P2, and P3, a paper feeding cassette 16, a manual paper feeding tray 17, and a catch tray 18.

The image forming apparatus 100 performs image formation by using image data corresponding to each of the four colors of black (K), as well as cyan (CY), magenta (M), and yellow (Y), which are the three primary subtractive colors obtained by separating colors of a color image, in image forming sections Pa to Pd corresponding to the respective colors. The respective image forming sections Pa to Pd are similar to one another in configuration, and for example, the image forming section Pa for black (K) is constituted by the photoreceptor drum 101*a*, the developing device 102*a*, the charging roller 103*a*, the primary transfer roller 13*a*, the cleaning unit 104*a*, and the like. The image forming sections Pa to Pd are arranged in alignment along a direction in which the intermediate transfer belt 11 moves (sub-scanning direction).

The charging rollers 103 are contact-type charging devices for charging surfaces of the photoreceptor drums 101 uniformly to a predetermined potential. Instead of the charging rollers 103, contact-type charging devices using a charging brush, or noncontact-type charging devices using a charging wire is also usable.

The exposure unit 10 includes a semiconductor laser (not shown), a polygon mirror 4, a first reflection mirror, a second reflection mirror 8, and the like, and irradiates each of the photoreceptor drums 101*a* to 101*d* with each light beam such as a laser beam modulated according to image data of the respective colors of black (K), cyan (CY), magenta (M), and yellow (Y). Each of the photoreceptor drums 101*a* to 101*d* forms thereon an electrostatic latent image corresponding to the image data of the respective colors of black (K), cyan (CY), magenta (M), and yellow (Y).

The developing devices 102 supply toner as developer to the surfaces of the photoreceptor drums 101 on which the electrostatic latent images are formed, to develop the electrostatic latent images to a toner image. The respective developing devices 102*a* to 102*d* contain toner of the respective colors of black (K), cyan (CY), magenta (M), and yellow (Y), and visualize the electrostatic latent images of the respective colors formed on the respective photoreceptor drums 101*a* to 101*d* into toner images of the respective colors. The cleaning units 104 remove and collect residual toner on the surfaces of the photoreceptor drums 101 after development and image transfer.

The intermediate transfer belt 11 provided above the photoreceptor drums 101 is supported around a driving roller 11*a* and a driven roller 11*b* with tension, and forms a loop-shaped moving path. An outer circumferential surface of the intermediate transfer belt 11 faces the photoreceptor drum 101*d*, the photoreceptor drum 101*c*, the photoreceptor drum 101*b* and the photoreceptor drum 101*a* in this order. The primary transfer rollers 13*a* to 13*d* are disposed at positions facing the respective photoreceptor drums 101*a* to 101*d* with the intermediate transfer belt 11 interposed therebetween. The respective positions at which the intermediate transfer belt 11 faces the photoreceptor drums 101*a* to 101*d* are primary transfer positions. In addition, the intermediate transfer belt 11 is formed of a film having thickness of 100 to 150 μm.

A primary transfer bias voltage having an opposite polarity to the polarity of the toner is applied under constant voltage control to the primary transfer rollers 13*a* to 13*d* in order to transfer the toner images borne on the surfaces of the photoreceptor drums 101*a* to 101*d* onto the intermediate transfer belt 11. Thus, the toner images of the respective colors formed on the photoreceptor drums 101*a* to 101*d* are transferred and overlapped onto the outer circumferential surface of the intermediate transfer belt 11 on top of each other to form a full-color toner image on the outer circumferential surface of the intermediate transfer belt 11.

Here, when image data for only a part of the colors of yellow (Y), magenta (M), cyan (CY) and black (B) is inputted, electrostatic latent images and toner images are formed at only a part of the photoreceptor drums 101 corresponding to the colors of the inputted image data among the four photoreceptor drums 101*a* to 101*d*. For example, during monochrome image formation, an electrostatic latent image and a toner image are formed only at the photoreceptor drum 101*a* corresponding to black color, and only a black toner image is transferred onto the outer circumferential surface of the intermediate transfer belt 11.

The respective primary transfer rollers 13*a* to 13*d* have a structure comprising a shaft having a diameter of 8 to 10 mm, made of a metal such as stainless steel and serving as a substrate, and a conductive elastic material (for example, EPDM or urethane foam) with which a surface of the shaft is coated, and uniformly apply a high voltage to the intermediate transfer belt 11 by the conductive elastic material.

The toner image transferred onto the outer circumferential surface of the intermediate transfer belt 11 at each of the primary transfer positions is conveyed to a secondary transfer position, which is a position facing the secondary transfer roller 14, by the rotation of the intermediate transfer belt 11. The secondary transfer roller 14 is brought into pressure-contact with, at a predetermined nip pressure, the outer circumferential surface of the intermediate transfer belt 11 whose inner circumferential surface is in contact with a circumferential surface of the driving roller 11*a* during image formation. While a recording paper sheet fed from the paper feeding cassette 16 or the manual paper feeding tray 17 passes between the secondary transfer roller 14 and the intermediate transfer belt 11, a high voltage with the opposite polarity to the charging polarity of the toner is applied to the secondary transfer roller 14. Thus, the toner image is transferred from the outer circumferential surface of the intermediate transfer belt 11 to the surface of the recording paper sheet.

Note that, of the toner attached from the photoreceptor drums 101 to the intermediate transfer belt 11, toner that has not been transferred onto the recording paper sheet and remains on the intermediate transfer belt 11 is collected by a transfer cleaning unit 12 in order to prevent color mixture in the following process.

The recording paper sheet to which the toner image is transferred is guided to a fixing device 15 described below according to an embodiment of the invention, passes through the fixing nip region, and is subjected to heat and pressure. Thus, the toner image is solidly fixed onto the surface of the recording paper sheet. The recording paper sheet onto which the toner image is fixed is discharged onto the sheet discharge tray 18 by the sheet discharge roller 18*a*.

Moreover, the image forming apparatus 100 is provided with the paper conveyance path P1 extending in the substantially vertical direction, for feeding a recording paper sheet contained in the paper feeding cassette 16 through a region between the secondary transfer roller 14 and the intermediate transfer belt 11, and by way of the fixing device 15, to the catch tray 18. The paper conveyance path P1 is provided with a pickup roller 16*a* for picking up recording paper sheets in the paper feeding cassette 16 in the paper conveyance path P1 sheet by sheet, conveying rollers 16*b* for conveying the fed recording paper sheet upward, registration rollers 19 for guiding the conveyed recording paper sheet between the secondary transfer roller 14 and the intermediate transfer belt 11 at a predetermined timing, and the paper discharge rollers 18*a* for discharging the recording paper sheet onto the catch tray 18.

Moreover, inside the image forming apparatus 100, the paper conveyance path P2 on which a pickup roller 17*a* and conveying rollers 16*b* are disposed is formed between the manual paper feeding tray 17 and the registration rollers 19. In addition, the paper conveyance path P3 is formed between the paper discharge rollers 18*a* and the upstream side of the registration rollers 19 in the paper conveyance path P1.

The paper discharge rollers 18*a* freely rotate in both forward and reverse directions, and are driven in the forward direction to discharge a recording paper sheet onto the catch tray 18 during single-sided image formation in which images are formed on one side of the recording paper sheets, and during second side image formation of double-sided image formation in which images are formed on both sides of the recording paper sheet. On the other hand, during first side image formation of double-sided image formation, the paper discharge rollers 18*a* are driven in the forward direction until a tail edge of the sheet passes through the fixing device 15, and are then driven in the reverse direction to bring the recording paper sheet into the paper conveyance path P3 in a state where the tail edge of the recording paper sheet is held. Thus, the recording paper sheet on which an image has been formed only on one side during double-sided image formation is brought into the paper conveyance path P1 in a state where the recording paper sheet is turned over and upside down.

The registration rollers 19 bring the recording paper sheet that has been fed from the paper feeding cassette 16 or the manual paper feeding tray 17, or has been conveyed through the paper conveyance path P3 between the secondary transfer roller 14 and the intermediate transfer belt 11 at a timing synchronized with the rotation of the intermediate transfer belt 11. Thus, the rotation of the registration rollers 19 is stopped when the operation of the photoreceptor drums 101 or the intermediate transfer belt 11 is started, and the movement of the recording paper sheet that has been fed or conveyed prior to the rotation of the intermediate transfer belt 11 is stopped in the paper conveyance path P1 in a state where a leading edge thereof abuts against the registration rollers 19. Then, the rotation of the registration rollers 19 is started at a timing when the leading edge of the recording paper sheet faces a leading edge of a toner image formed on the intermediate transfer belt 11 at a position where the secondary transfer roller 14 is brought into pressure-contact with the intermediate transfer belt 11.

Note that, during full-color image formation in which image formation is performed by all of the image forming sections Pa to Pd, all of the primary transfer rollers 13*a* to 13*d* bring the intermediate transfer belt 11 into pressure-contact with the photoreceptor drums 101*a* to 101*d*. On the other hand, during monochrome image formation in which image formation is performed only by the image forming section Pa, only the primary transfer roller 13*a* brings the intermediate transfer belt 11 into pressure-contact with the photoreceptor drum 101*a*.

Figure 2:
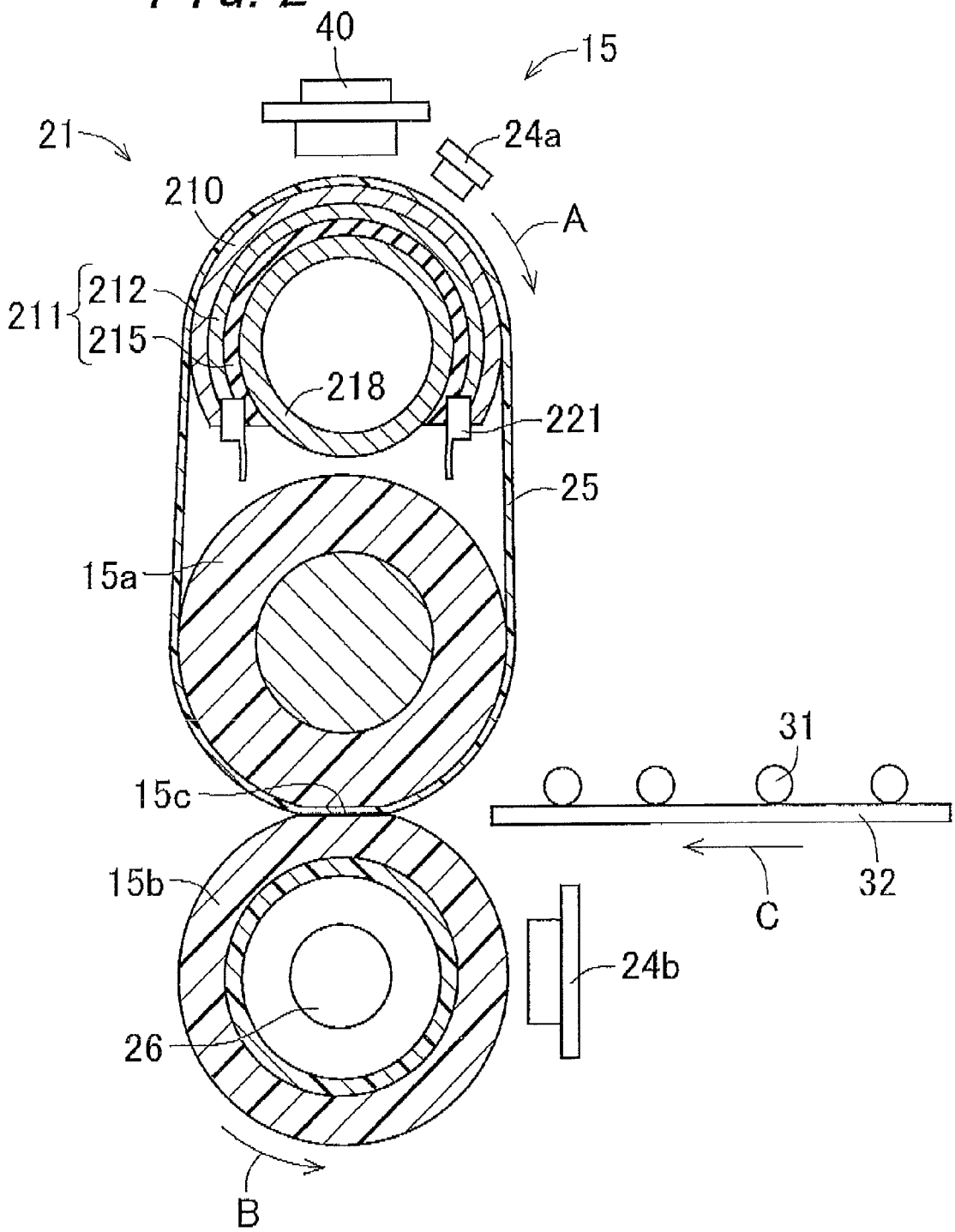
FIG. 2 is a view showing a structure of a fixing device according to a first embodiment of the invention.

FIG. 2 is a view showing the structure of the fixing device 15 according to a first embodiment of the invention. The fixing device 15 includes a fixing roller 15*a* serving as a first fixing member, a pressure roller 15*b* serving as a second fixing member, a fixing belt 25 serving as an endless-shaped belt member, and a heating member 21. In the fixing device 15, the fixing belt 25 is supported around the fixing roller 15*a* and the heating member 21 with tension, and the pressure roller 15*b* is disposed so as to face the fixing roller 15*a*, with the fixing belt 25 interposed therebetween. Moreover, the fixing roller 15*a* and the heating member 21 are arranged substantially in parallel with each other in an axial direction of the fixing roller 15*a*. With this arrangement, the fixing belt 25 supported around the fixing roller 15*a* and the heating member 21 with tension can be prevented from running windingly during its sliding movement, wherefore the durability of the fixing belt 25 can be maintained at a high level.

The fixing device 15 is a fixing device of belt fixing type in which the heating member 21 comes into contact with the fixing belt 25 to heat the fixing belt 25, and when the recording paper sheet 32 serving as a recording medium passes through the fixing nip region 15*c* defined by the fixing belt 25 and the pressure roller 15*b* at predetermined fixing speed and copy speed, fixes the unfixed toner images 31 borne on the recording paper sheet 32 under application of heat and pressure. The fixing device 15 of belt fixing type is configured such that the fixing belt 25 having a small heat capacity is heated by the heating member 21 having the high-power-density heat generating layer 212. Therefore, a warm-up time is short, and an increase in power consumption is suppressed, thereby achieving power savings.

Note that the unfixed toner image 31 is formed of, for example, a developer (toner) such as a non-magnetic one-component type developer (non-magnetic toner), a non-magnetic two-component type developer (non-magnetic toner and carrier), or a magnetic developer (magnetic toner). Moreover, the "fixing speed" corresponds to a so-called process speed, and the "copying speed" corresponds to the number of copies obtained per minute. Further, when the recording paper sheet 32 passes through the fixing nip region 15*c*, the fixing belt 25 abuts against that surface of the recording paper sheet 32 which is opposite from the toner image-bearing surface thereof.

The fixing roller 15*a* is brought into pressure-contact with the pressure roller 15*b* with the fixing belt 25 interposed therebetween to thereby form the fixing nip region 15*c*, and at the same time, is rotated in a rotation direction A around a rotation axis by a not-shown driving motor (driving section) to thereby cause the fixing belt 25 to run. The fixing roller 15*a* has a diameter of 30 mm and has a two-layered structure consisting of a core metal and an elastic layer, which are formed in this order from inside. For the core metal, for example, a metal such as iron, stainless steel, aluminum, and copper, an alloy thereof, or the like are used. Moreover, for the elastic layer, a rubber material having heat resistance such as silicone rubber and fluorine rubber is suitable. Note that, in this embodiment, a force when the fixing roller 15*a* is brought into pressure-contact with the pressure roller 15*b* with the fixing belt 25 interposed therebetween is about 216 N.

The pressure roller 15*b* is provided to be opposite and in pressure-contact with the fixing roller 15*a* with the fixing belt 25 interposed between. The pressure roller 15*b* is freely rotatable around its rotation axis. The pressure roller 15*b* is rotated in a rotation direction B by rotation of the fixing roller 15*a*. The pressure roller 15*b* has a three-layered structure consisting of a core metal, an elastic layer, and a release layer, which are formed in this order from inside. For the core metal, for example, a metal, such as iron, stainless steel, aluminum, or copper, or an alloy thereof is used. For the elastic layer, a heat resistant rubber material such as silicone rubber or fluorine rubber is suitable. For the release layer, fluorine resin such as PFA (a copolymer of tetrafluoroethylene and perfluoroalkyl vinyl ether) or PTFE (polytetrafluoroethylene) is suitable. For the pressure roller 15*b*, for example, a roller may be used in which the diameter of the roller is 30 mm, an iron (STKM) pipe having a diameter of 24 mm (thickness 2 mm) is used for the core metal, solid silicon rubber having a thickness of 3 mm is used for the elastic layer, and a PFA tube having a thickness of 30 μm is used for the release layer.

The pressure roller 15*b* is provided with a heater lamp 26 (for example, rated power 400 W) in an interior thereof to heat the pressure roller 15*b*. A control circuit (not shown) causes power to be supplied (energized) from a power supply circuit (not shown) to the heater lamp 26, the heater lamp 26 emits light, and infrared rays are radiated from the heater lamp 26. Thus, the inner circumferential surface of the pressure roller 15*b* absorbs the infrared rays and is heated, such that the entire pressure roller 15*b* is heated. Although the above-described heater lamp 26 heats the pressure roller 15*b* from the inner surface, the pressure roller 15*b* may be heated by a roller for outer circumference heating, from a surface thereof.

The fixing belt 25 is heated to a predetermined temperature by the heating member 21 and heats the recording paper sheet 32 having the unfixed toner image 31 formed thereon that passes through the fixing nip region 15*c*. The fixing belt 25 is an endless-shaped belt and is supported around the heating member 21 and the fixing roller 15*a* and wound up by the fixing roller 15*a* with a predetermined angle. During rotation of the fixing roller 15*a*, the fixing belt 25 is rotated in the rotation direction A by rotation of the fixing roller 15*a*. The fixing belt 25 has a three-layered structure consisting of a substrate having a hollow cylindrical shape made of a heat resistant resin such as polyimide or a metal material such as stainless steel and nickel, an elastic layer formed on a surface of the substrate, made of an elastomer material (for example, silicone rubber) having excellent heat resistance and elastic property, and a release layer formed on a surface of the elastic layer, made of a synthetic resin material (for example, a fluorine resin such as PFA or PTFE) having excellent heat resistance and releasing property. Moreover, a fluorine resin may be added into polyimide constituting the substrate. This makes it possible to reduce a slide load with the heating member 21.

The heating member 21 is a member that comes into contact with the fixing belt 25 to heat the fixing belt 25 to a predetermined temperature. In the fixing device 15, a heat generating element-side thermistor 24*a* and a pressure roller-side thermistor 24*b* serving as a temperature detecting section are respectively provided on the circumferential surface of the fixing belt 25 in contact with the heating member 21 and on the circumferential surface of the pressure roller 15*b* to detect surface temperature.

Figure 3:
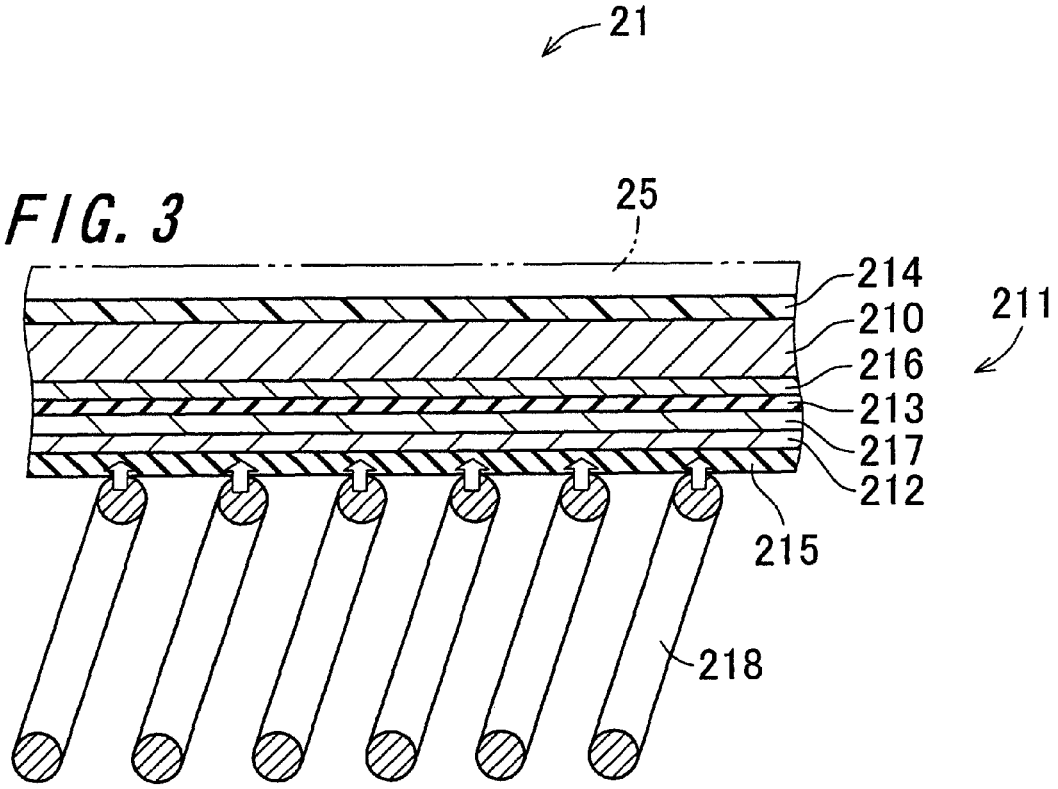
FIG. 3 is a view showing a configuration of a heating member provided in the fixing device.

FIG. 3 is a view showing a configuration of the heating member 21 provided in the fixing device 15. The heating member 21 has a semicircular shape and includes a heat radiating member 210, a heat generating member 211 and an inside securing member 218.

The heat radiating member 210 is a member which extends in a width direction of the fixing belt 25 (an axial direction of the fixing roller 15*a*) and has a curved shape along a surface of the fixing belt 25, and is arranged to contact the fixing belt 25 on the outer circumferential surface thereof so as to transmit heat generated from the heat generating member 211 to the fixing belt 25. Although a material that constitutes the heat radiating member 210 is not particularly limited, a metal material having high thermal conductivity is preferable, and as the metal material, iron, aluminum, copper or the like is able to be included, however, stainless steel is also usable. Then, in the heat radiating member 210, a coat layer 214 is formed on the outer circumferential surface thereof in contact with the fixing belt 25.

The coat layer 214 should be formed by a material having thermal conductivity for conducting heat generated from the heat generating member 211 to the fixing belt 25, and capable of reducing the frictional force with the fixing belt 25. By forming such a coat layer 214, heat is conducted to the fixing belt 25 as well as wear of the fixing belt 25 that slides in contact with the heat radiating member 210 is prevented so that excellent durability is able to be secured. Moreover, since the frictional force with the fixing belt 25 is able to be reduced, load to the fixing roller 15*a* and the pressure roller 15*b* which drive the fixing belt 25 is able to be reduced, and durability of the respective rollers 15*a* and 15*b* is ensured, thus enables driving by a lower torque. Examples of the material constituting the coat layer 214 include a fluorine resin such as a PFA or a PTFE. In the embodiment, the coat layer 214 is a layer formed of a PTFE and having a thickness of 20 μm.

The inside securing member 218 is a member that holds the heat generating member 211 by being in line-contact with or in point-contact with one surface of a thickness direction of the heat generating member 211 so as to elastically press the heat generating member 211 toward a direction moving closer to the heat radiating member 210 and by allowing another surface of the thickness direction of the heat generating member 211 to be in surface-contact with the inside surface of the heat radiating member 210. The inside securing member 218 allows the heat generating layer 212 composed of the resistance heat generating element such as a ceramic heat generating element or a metallic heat generating element to contact an inner surface stably so that heat generated from the heat generating layer 212 is heat-transferred effectively to the heat radiating member 210, and thereby prevents that only the resistance heat generating element of the heat generating layer 212 is regionally overheated and breakage thereof is caused.

In the embodiment, the inside securing member 218 is a spiral-shaped member formed to be a spiral shape using a wire. Specifically, a wire formed of stainless steel and having a wire diameter of 1 mm is formed to be a spiral shape and an outer diameter of the coil in a stationary placed state is 29.5 mm, and a space between respective spires is 5 mm. A material constituting the wire may be, other than stainless steel, for example, copper, iron, nickel, alloy thereof, or heat resistant resin. In a case where the inside securing member 218 is formed of the heat resistant resin, the member is able to be caused to be more excellent in heat insulation compared with a case of being formed by metal, and it is possible to increase an effect to suppress heat loss caused by transmitting heat generated in the heat generating layer 212 to the inside securing member 218 and dissipated. On the other hand, in a case where the inside securing member 218 is formed of metal, the member is able to be caused to be more excellent in heat resistance and elastic coefficient thereof is higher compared with a case of being formed by the resin, and it is possible to increase an effect of elastically pressing the heat generating member 211 toward the direction moving closer to the heat radiating member 210 so as to hold stably at a predetermined position.

In addition, the wire diameter, the coil outer diameter, the space of spires, and constituent material of the wire are not limited to the above-described configuration, and setting may be performed such that spring elasticity is able to be exerted under high temperature environment when formed into a spiral shape.

A fixing method of holding and fixing the heat generating member 211 using the inside securing member 218 at a predetermined position which faces the inside surface of the heat radiating member 210 is as follows. First, another surface of the thickness direction of the heat generating member 211 is arranged to face the inside surface of the heat radiating member 210. Next, the inside securing member 218 formed to be a spiral shape is fixed so that, of an outer circumferential part of each of the spires of the spiral shaped part which lies outwardly in a radial direction thereof, an entire part facing a surface of the thickness direction of the heat generating member 211 is to be in line-contact with an entire region across a circumferential direction (short-side direction) of the heat generating member 211. At this time, in the inside securing member 218 formed to be a spiral shape, force to restore acts by the elasticity generated by the change of the coil outer diameter in the spiral shaped part, and the restoring force to restore acts as force to elastically press the heat generating member 211 toward the direction moving closer to the heat radiating member 210. In this manner, since the restoring force of the inside securing member 218 acts to hold the heat generating member 211 on the inside surface of the heat radiating member 210, the heat generating member 211 is held in a state where another surface of the thickness direction thereof is in surface-contact with the inside surface of the heat radiating member 210.

Since the heat generating member 211 is elastically pressed and held toward the direction moving closer to the heat radiating member 210 by the restoring force of the inside securing member 218, even though the heat radiating member 210 and the heat generating member 211 expand and contract by heating, or the inside securing member 218 itself expands and contracts by heat, the spiral shaped part of the inside securing member 218 shifts in accordance with the expansion and contraction, and thereby the heat generating member 211 is able to be stably held at a predetermined position on the inside surface of the heat radiating member 210. Moreover, by changing the space and the arranged position of each of the spires in the spiral shaped part of the inside securing member 218, pressing force distribution of the heat generating member 211 against the inside surface of the heat radiating member 210 is able to be changed.

As above, the heating member 21 in which the inside securing member 218 is in line-contact with a surface of the thickness direction of the heat generating member 211 to elastically press the heat generating member 211 toward the direction moving closer to the heat radiating member 210, and the heat generating member 211 is held so that another surface of the thickness direction thereof is in surface-contact with the inside surface of the heat radiating member 210.

Note that, in the inside securing member 218, other than forming into a spiral shape by using a wire whose cross-section is a circular shape, an extra fine plate-like member whose cross-section is an elliptical shape or a polygonal shape may be used to form a spiral shape. Furthermore, a shape of each of the spires when viewed from the axial direction in a state where the inside securing member 218 formed to be a spiral shape is stationary placed is able to be set to various shapes. Additionally, in the embodiment, although the inside securing member 218 formed into a spiral shape is used, it is not limited thereto, and may be configured by various shapes and material, when the configuration is such that holding the heat generating member 211 by being in line-contact with or in point-contact with the surface of the thickness direction of the heat generating member 211 so as to elastically press the heat generating member 211 toward the direction moving closer to the heat radiating member 210 and thereby allows another surface of the thickness direction of the heat generating member 211 to be in surface-contact with the inside surface of the heat radiating member 210.

The heat generating member 211 is held so that the inside securing member 218 is in line-contact or in point-contact with a surface of the thickness direction thereof and thereby allows another surface of the thickness direction thereof to be in surface-contact with the heat radiating member 210. The heat generating member 211 has a layered structure in which on the surface of a second insulating layer 215, a heat generating layer 212, a second good thermal conductor layer 217, a first insulating layer 213, and a first good thermal conductor layer 216 are layered in this order, and a surface of a side on which the second insulating layer 215 is formed is a surface of a side in contact with the inside securing member 218, and a surface of a side on which the first good thermal conductor layer 216 is formed is a surface of a side in contact with the inside surface of the heat radiating member 210. Then, the heat generating member 211 extends in the longitudinal direction of the heat radiating member 210 (width direction of the fixing belt 25), and is held by the inside securing member 218 so as to be in surface-contact with the heat radiating member 210 along a curved inside surface thereof. Then, at both end portions in the longitudinal direction of the heat generating member 211 (longitudinal direction of the heat radiating member 210), power feeding terminal sections 221 are formed.

The first insulating layer 213 and the second insulating layer 215 are layers formed by a material having both the heat resistance and the electrical insulation properties. As the material having both the heat resistance and the electrical insulation properties, although not particularly limited, examples thereof include a heat resistant polymer material such as a polyimide resin and ceramics material such as alumina. In the embodiment, the first insulating layer 213 and the second insulating layer 215 are layers formed of a polyimide resin and having a thickness of 30 μm. The first insulating layer 213 is interposed between the heat generating layer 212 and the heat radiating member 210 to ensure insulation therebetween, and the second insulating layer 215 is interposed between the heat generating layer 212 and the inside securing member 218 to ensure insulation therebetween. In this manner, since the first insulating layer 213 and the second insulating layer 215 electrically insulate the heat generating layer 212 composed of the resistance heat generating element that generates heat due to being energized, it is possible obtain the heating member 21 being free from danger. Furthermore, in the embodiment, although it is configured that two layers each formed of a polyimide resin and having a thickness of 30 μm are provided as the insulator, in order to improve electrical insulation property, the thickness may be made thicker (for example, 100 μm) or the number of layers may be increased. In addition, the first insulating layer 213 and the second insulating layer 215 are preferable to have the high thermal conductivity, and thereby degradation of the heating property of the heating member 21 is able to be prevented.

The first good thermal conductor layer 216 that is interposed between the heat radiating member 210 and the first insulating layer 216, and the second good thermal conductor layer 217 that is interposed between the heat generating layer 212 and the first insulating layer 216 are layers formed for improving the thermal conductivity with which heat generated in the heat generating layer 212 is conducted to the heat radiating member 210. As a material constituting the first good thermal conductor layer 216 and the second good thermal conductor layer 217, although not particularly limited when the material is excellent in thermal conductivity even under the high temperature environment and hard to cause a time-dependent change, examples thereof include a heat resistant silicone grease having heat resistance of 300° C. or more. Furthermore, in order to further improve the thermal conductivity, one that powder of gold, silver, copper, platinum, carbon or graphite is added to the heat resistant silicone grease may be used, and when the substance is such as rubber, metal which is rich in elasticity, or the like, to accelerate the thermal conduction by filling a gap of a contact part, although the material is not particularly limited, nor the form of solid, liquid or gas is considered, the one whose heat capacity is small and thermal conductivity is high is preferable. Moreover, the first good thermal conductor layer 216 and the second good thermal conductor layer 217 are preferable to have the higher thermal conductivity than other that of layers constituting the heat generating member 211, and thereby degradation of the heating property of the heating member 21 is able to be prevented.

When a space is formed between the heat generating layer 212 and the first insulating layer 213, and in a overlapping part on the surface of the side that contacts the inside surface of the heat radiating member 210, a layer of air is interposed therebetween and thereby the thermal conductivity deteriorates. Therefore, by arranging the first and second good thermal conductor layers 216 and 217, the layer of air that increases resistance to heat is removed and thereby the thermal conductivity is able to be improved. Moreover, when the first good thermal conductor layer 216 is arranged between the heat generating layer 212 and the first insulating layer 213, and the second good thermal conductor layer 217 is arranged on the surface of the side that contacts the inside surface of the heat radiating member 210, since heat generated in the heat generating layer 212 is quickly transmitted to the inside surface of the heat radiating member 210 through the first and second good thermal conductor layers 216 and 217, shortening of the warm-up time or uniformity of the temperature distribution on the surface of the heat radiating member 210 is able to be ensured in a short time, and even in the high-speed printing, sufficient amount of heat is able to be supplied from the heat radiating member 210 to the fixing belt 25.

Figure 4:
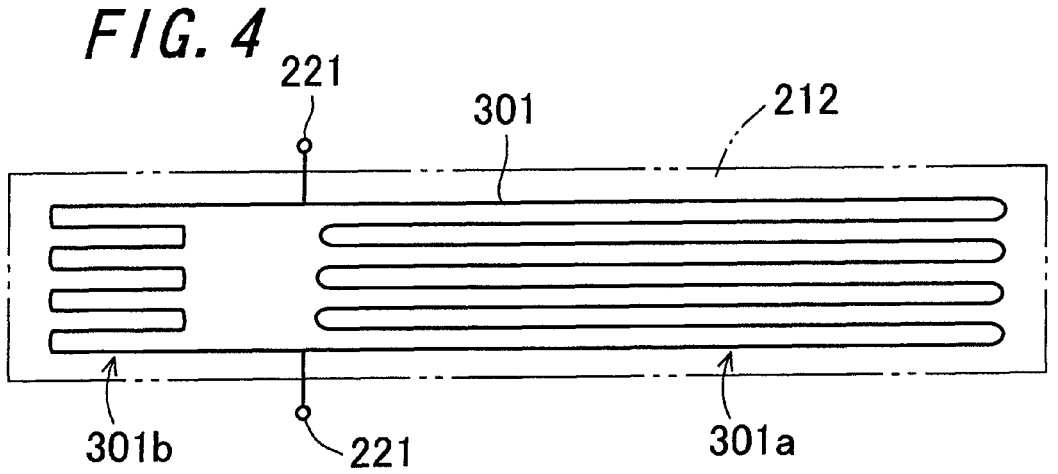
FIG. 4 is a view showing a configuration of a resistance heat generating element.

Next, description will be given for the heat generating layer 212 provided in the heat generating member 211. The heat generating layer 212 is a layer composed of the resistance heat generating element that generates heat with the Joule heat generated by applying voltage to the power feeding terminal section 221 to be energized. FIG. 4 is a view showing a configuration of the resistance heat generating element 301 formed on the heat generating layer 212. In the heat generating layer 212, one piece of resistance heat generating element 301 repeats flexions so as to form a fixed surface as a whole. Whereby, the efficiency of heat transfer in transmitting heat of the resistance heat generating element 301 generated due to being energized to the heat radiating member 210 is able to be improved.

Examples of the resistance heating element 301 constituting the heat generating layer 212 include a metal material mainly containing nickel-chromium alloy, a metal resistor having an electrically resistive component made of stainless steel, and a resistant material such as silver-palladium-based material. A ceramic heating element in which a resistance wire having a width of about 1 mm is formed on a ceramic substrate having a width of 12 mm by screen printing, a ceramic heating element in which a plurality of thin-film ceramic sheets are laminated and a fine resistance wire is formed between the sheets and fired, or a ceramic heating element in which an inorganic material mainly containing barium titanate-based semiconductor ceramic is fired may be used as a resistance heating element 301. A ceramic heating element is a heating element that can realize high power density. Thus, the heat generating member 211 that has the heat generating layer 212 including a ceramic heating element has a high thermoresponsive rate, thereby reducing the warm-up time, and has high heating capability with respect to the heat radiating member 210.

The resistance heat generating element 301 then includes a paper passing region heating section 301*a* and a detecting section 301*b*. The paper passing region heating section 301*a* of the resistance heat generating element 301 is formed in a region which is the heat generating source part for heating the paper passing region of the fixing belt 25, which is on the surface of the heat generating layer 212. The detecting section 301*b* of the resistance heat generating element 301 is provided on an end portion of the axial direction (longitudinal direction) of the heat generating member 211 corresponding to the paper non-contacting region of the recording paper sheet 32 (region that even the recording paper sheet 32 of a maximum size does not contact) on the fixing belt 25, and electrically connected in parallel with the paper passing region heating section 301*a*.

Note that, the paper passing region heating section 301*a* of the heat generating layer 212 is formed to have a substantially equivalent area to a contact area where the heat radiating member 210 contacts the fixing belt 25, and the detecting section 301*b* of the heat generating layer 212 is formed to have a substantially equivalent area to a heat receiving surface of an overheat preventing element 40.

Then, in a vicinity of the detecting section 301*b* of the resistance heat generating element 301, the overheat preventing element 40 is provided. The overheat preventing element 40 is one which suppresses energization to the resistance heat generating element 301 when the temperature of the detecting section 301*b* of the resistance heat generating element 301 reaches a predetermined value, and for example, a thermostat or a thermal protector. The overheat preventing element 40 formed of the thermostat or the thermal protector receives heat energy radiated from the detecting section 301*b* on the heat receiving surface and when the temperature of the detecting section 301*b* reaches the predetermined value, bimetal inside thereof acts to open a contact circuit so as to cut off the energization to the resistance heat generating element 301.

FIGS. 5A to 5E are views showing an arranged position of the overheat preventing element 40 in a vicinity of the detecting section 301*b* of the resistance heat generating element 301. The overheat preventing element 40 is provided in the vicinity of the detecting section 301*b* so as to detect the temperature change due to energization in the detecting section 301*b* of the resistance heat generating element 301. Here, since the temperature rising speed, the thermal conductivity or the radiant condition varies depending on an element such as curvature of the surface (detecting surface) of a target object arranged opposite to the overheat preventing element 40, an area, the structure and the material of the heat receiving surface of the overheat preventing element 40 itself, or the structure and the material of each of layers of the heat generating member 211, the arranging position of the overheat preventing element 40 is decided in consideration of these points.

Figure 5A:
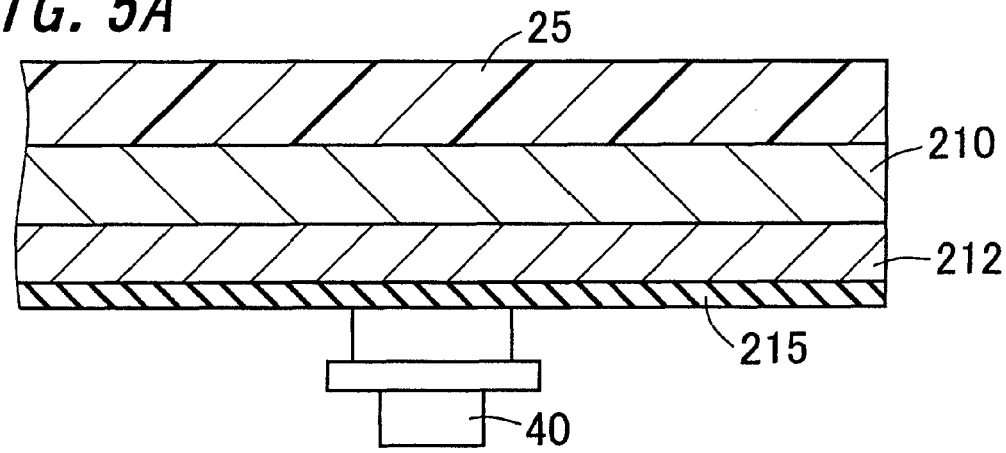
FIGS. 5A to 5E are views showing an arranged position of an overheat preventing element in a vicinity of a detecting section of the resistance heat generating element.
Figure 5B:
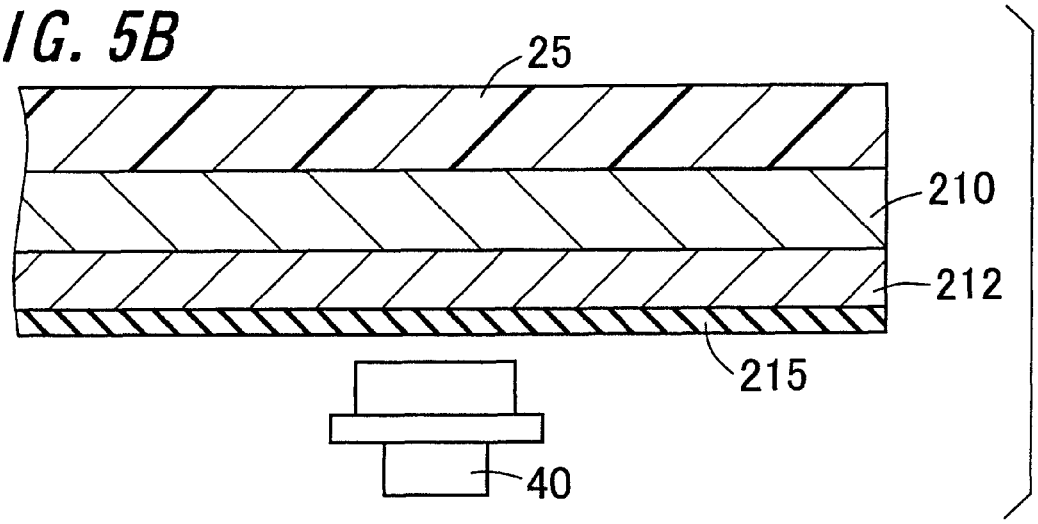

The overheat preventing element 40 may be arranged opposite to the second insulating layer 215 in a contact manner as shown in FIG. 5A, or in a non-contact manner as shown in FIG. 5B, the second insulating layer 215 corresponding to a region part of the heat generating layer 212 in which the detecting section 301*b* of the resistance heat generating element 301 is provided, the region part being an end portion of the axial direction (longitudinal direction) of the heat radiating member 210 in contact with the fixing belt 25.

Figure 5C:
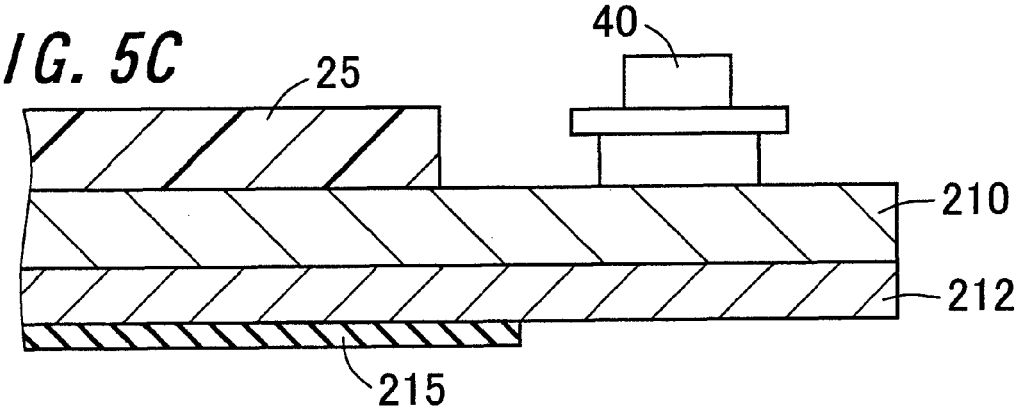
Figure 5D:
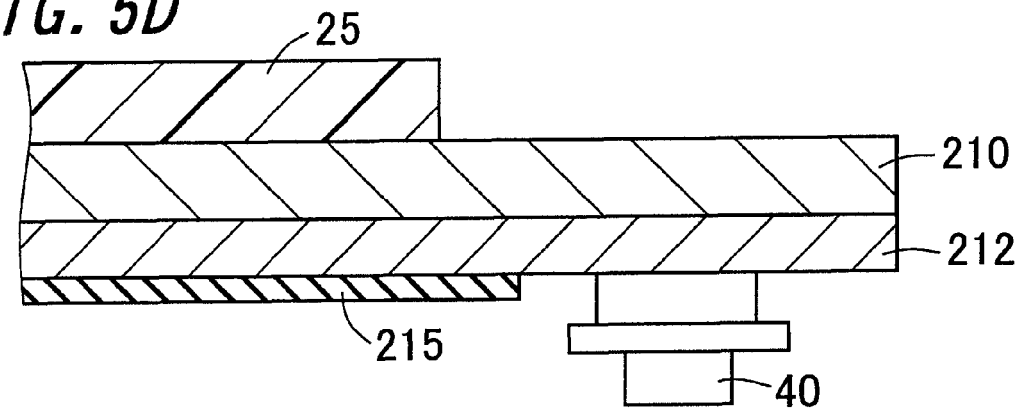
Figure 5E:
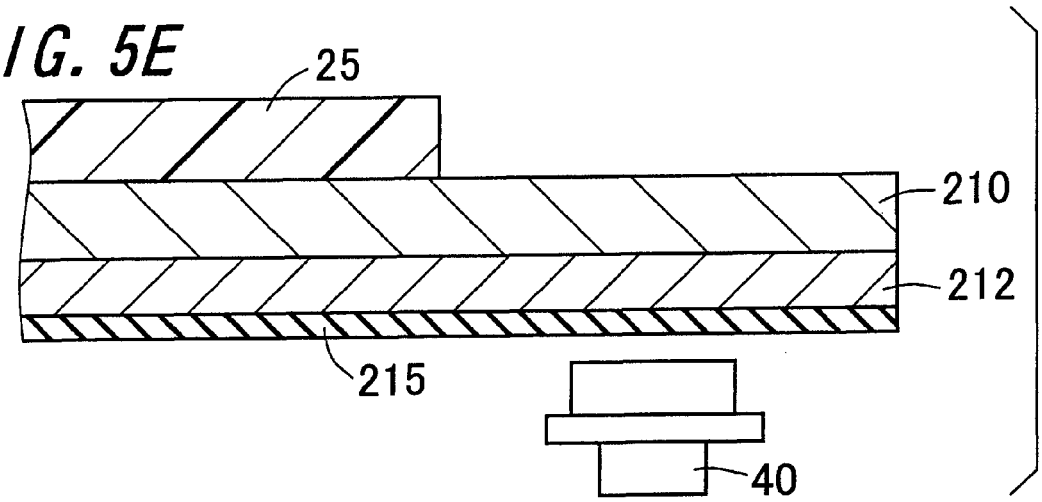

Furthermore, the overheat preventing element 40 may be arranged opposite to the heat radiating member 210 in a contact manner as shown in FIG. 5C, or may be arranged opposite to the heat generating member 212 in a contact manner, corresponding to a region part, in which the second insulating layer 215 is not formed, of the heat generating layer 212 in which the detecting section 301*b* of the resistance heat generating element 301 is provided, the region part being an end portion of the axial direction (longitudinal direction) of the heat radiating member 210 in non-contact with the fixing belt 25. Moreover, as shown in FIG. 5E, the overheat preventing element 40 may be arranged opposite to the second insulating layer 215 in a non-contact manner, the second insulating layer 215 corresponding to a region part of the heat generating layer 212 in which the detecting section 301*b* of the resistance heat generating element 301 is provided, the region part being an end portion of the axial direction (longitudinal direction) of the heat radiating member 210 in non-contact with the fixing belt 25.

When the heat generating layer 212 generates heat by applying voltage to the resistance heat generating element 301 from the power feeding terminal section 221, and the fixing belt 25 coming into contact with the heat radiating member 210 is heated by using the generated heat, in a case where the control of energization to the resistance heat generating element 301 constituting the heat generating layer 212 is not able to be performed because of the failure of the control circuit, an unexpected control program behavior, or the failure of the switching element, there is a case where the resistance heat generating element 301 becomes an overheated state and results in smoke generation, ignition, or burnout.

The overheat preventing element 40 detects the temperature abnormality under which the resistance heat generating element 301 becomes the overheated state, and by suppressing the energization to the resistance heat generating element 301 based on the detection result, it is possible to prevent that the resistance heat generating element 301 results in smoke generation, ignition, or burnout.

Additionally, since the resistance heat generating element 301 of high power density has high temperature rising speed due to energization, in order to prevent the resistance heat generating element 301 from becoming overheated state, the temperature abnormality under which the resistance heat generating element 301 becomes the overheated state should be detected further earlier. Furthermore, unless the temperature abnormality detection is executed by the overheat preventing element 40 at a place where temperature rising speed is high or a place where power density is high in the resistance heat generating element 301, it is impossible to prevent the resistance heat generating element 301 to result in smoke generation, ignition or burnout when there is a part which has greater temperature change than the detected part.

In order to detect the temperature abnormality under which the resistance heat generating element 301 becomes the overheated state further earlier, the overheat preventing element 40 may be arranged to be in contact with the fixing belt 25 or the heating member 21, however, in such a case, there is a possibility that as well as a failure occurs in a fixed image on the recording paper sheet 32, the temperature distribution of the surface of the fixing belt 25 becomes non-uniform. Moreover, when the overheat preventing element 40 is arranged to be in contact with the fixing belt 25 or the heating member 21, there is a possibility that detection sensitivity of the overheat preventing element 40 becomes poor and thereby the temperature abnormality itself is not possible to be detected.

Moreover, in the fixing device 15, a width of a paper non-passing region on the surface of the fixing belt 25 varies depending on a size of the recording paper sheet 32 to be supplied to the fixing nip region 15*c*. In the paper non-passing region on the surface of the fixing belt 25, which the recording paper sheet 32 does not contact, since heat generated from the heat generating layer 212 will not be taken by the recording paper sheet 32, a regional part of the resistance heat generating element 301 that corresponds to the paper non-passing region becomes an excessive temperature rising state. In this way, when the resistance heat generating element 301 becomes the excessive temperature rising state regionally corresponding to the paper non-passing region, there is a case where the overheat preventing element 40 that detects the overheated state of the resistance heat generating element 301 operates erroneously.

Contrary to this, in the fixing device 15, since the configuration is such that energization to the resistance heat generating element 301 is controlled by the overheat preventing element 40 provided in the vicinity of the detecting section 301*b* arranged on the end portion of the axial direction of the heat generating member 211 corresponding to the paper non-contacting region of the recording paper sheet 32 of the fixing belt 25, irrespective of the size of the recording paper sheet 32 to be supplied to the fixing nip region 15*c*, the overheated state of the paper passing region heating section 301*a* is able to be indirectly detected from the temperature change in the detecting section 301*b* corresponding to the paper non-passing region of the fixing belt 25 which the recording paper sheet 32 does not contact all the time, and thereby it is possible to prevent that the overheat preventing element 40 operates erroneously.

Furthermore, since the paper passing region heating section 301*a* and the detecting section 301*b* are electrically connected in parallel, the resistance heat generating element 301 that generates heat due to being energized is prevented from being subjected to a disturbance factor such as variation in applied voltage to the paper passing region heating section 301*a* and the detecting section 301*b*. Thereby, when the resistance heat generating element 301 is energized, the temperature changes in the paper passing region heating section 301*a* and the detecting section 301*b* are the same, and the overheated state of the paper passing region heating section 301*a* is able to be indirectly detected by the overheat preventing element 40 accurately from the temperature change in the detecting section 301*b* due to energization. Therefore, it is possible to prevent the paper passing region heating section 301*a* of the resistance heat generating element 301 from becoming an overheated state and resulting in smoke generation, ignition or burnout, and high safety is able to be secured.

Moreover, in the resistance heat generating element 301 that generates heat due to being energized, the paper passing region heating section 301*a* and the detecting section 301*b* preferably have an equivalent power density. Thereby, when the resistance heat generating element 301 is energized, the temperature changes in the paper passing region heating section 301*a* and the detecting section 301*b* are the same, and thereby the overheated state of the paper passing region heating section 301*a* is able to be indirectly detected by the overheat preventing element 40 accurately from the temperature change in the detecting section 301*b* due to energization.

Here, the configuration in which the paper passing region heating section 301*a* and the detecting section 301*b* have an equivalent power density is that the power density of the detecting section 301*b* to the power density of the paper passing region heating section 301*a* is adjusted to be in a range of (power density of the paper passing region heating section±10%), preferably (power density of the paper passing region heating section+10%). By adjusting the power density of the detecting section 301*b* to the power density of the paper passing region heating section 301*a* to be in a range of (power density of the paper passing region heating section+10%), the temperature change in the detecting section 301*b* becomes equivalent to or more than the paper passing region heating section 301*a*, and thereby in indirectly detecting the overheated state of the paper passing region heating section 301*a* from the temperature change in the detecting section 301*b* due to energization, it is possible to detect the overheated state of the paper passing region heating section 301*a* further earlier.

Additionally, in the resistance heat generating element 301 that generates heat due to being energized, the paper passing region heating section 301*a* and the detecting section 301*b* may be configured to have an equivalent temperature rising speed in generating heat due to being energized. Whereby, when the resistance heat generating element 301 is energized, the temperature changes in the paper passing region heating section 301*a* and the detecting section 301*b* are the same, and thereby the overheated state of the paper passing region heating section 301*a* is able to be indirectly detected by the overheat preventing element 40 accurately from the temperature change in the detecting section 301*b* due to energization.

Here, the configuration in which the paper passing region heating section 301*a* and the detecting section 301*b* have an equivalent temperature rising speed is that the temperature rising speed of the detecting section 301*b* to the temperature rising speed of the paper passing region heating section 301*a* is adjusted to be in a range of (temperature rising speed of the paper passing region heating section±10%), preferably (temperature rising speed of the paper passing region heating section+10%). By adjusting the temperature rising speed of the detecting section 301*b* to the temperature rising speed of the paper passing region heating section 301*a* to be in a range of (temperature rising speed of the paper passing region heating section+10%), the temperature change in the detecting section 301*b* becomes equivalent to or more than the paper passing region heating section 301*a*, and thereby in indirectly detecting the overheated state of the paper passing region heating section 301*a* from the temperature change in the detecting section 301*b* due to energization, it is possible to detect the overheated state of the paper passing region heating section 301*a* further earlier.

Furthermore, in the resistance heat generating element 301 that generates heat due to being energized, the paper passing region heating section 301*a* and the detecting section 301*b* may be configured to have an equivalent specific heat capacity. Whereby, when the resistance heat generating element 301 is energized, the temperature changes in the paper passing region heating section 301*a* and the detecting section 310*b* are the same, and the overheated state of the paper passing region heating section 301*a* is able to be indirectly detected by the overheat preventing element 40 accurately from the temperature change in the detecting section 301*b* due to energization.

Here, the configuration in which the paper passing region heating section 301*a* and the detecting section 301*b* have an equivalent specific heat capacity is that the specific heat capacity of the detecting section 301*b* to the specific heat capacity of the paper passing region heating section 301*a* is adjusted to be in a range of (specific heat capacity of the paper passing region heating section±10%), preferably (specific heat capacity of the paper passing region heating section+10%). By adjusting the specific heat capacity of the detecting section 301*b* to the specific heat capacity of the paper passing region heating section 301*a* to be in a range of (specific heat capacity of the paper passing region heating section+10%), the temperature change in the detecting section 301*b* becomes equivalent to or more than the paper passing region heating section 301*a*, and thereby in indirectly detecting the overheated state of the paper passing region heating section 301*a* from the temperature change in the detecting section 301*b* due to energization, it is possible to detect the overheated state of the paper passing region heating section 301*a* further earlier.

As described above, the configuration in which the power density is equivalent, the configuration in which the temperature rising speed is equivalent, and the configuration in which the specific heat capacity is equivalent, where the temperature changes in the paper passing region heating section 301*a* and the detecting section 301*b* are the same, are able to be realized by adjusting an amount of generating heat, electrical resistance, a material, a thickness, an area and the like of the detecting section 301*b* to the paper passing region heating section 301*a* in consideration of the surrounding environment in which the overheat preventing element 40 is arranged. Furthermore, temperature detecting capability of the detecting section 301*b* by the overheat preventing element 40 may be adjusted by coating (or attaching) a material which is able to adjust (increase or reduce) the thermal conductivity on the surface of the detecting section 301*b* (detecting surface).

In addition, as the resistance heat generating element 301, it is preferable to use one having positive resistance-temperature property (Positive Temperature Coefficient, abbreviated as PTC property). In the resistance heat generating element 301 having the positive resistance-temperature property, electrical resistance increases as temperature rises. In such a resistance heat generating element 301 having the positive resistance-temperature property, when the temperature thereof becomes a predetermined temperature or more, the electrical resistance sharply increases and the current value becomes small, thereby becoming the overheated state is prevented. Moreover, in the resistance heat generating element 301 having the positive resistance-temperature property, since the current value becomes small as the temperature rises, amount of power consumption is able to be reduced and the energy saving is able to be realized. Moreover, since the resistance heat generating element 301 has the paper passing region heating section 301*a* and the detecting section 301*b*, even though the resistance heat generating element 301 is the heat generating element having the positive resistance-temperature property, it is possible to indirectly detect the overheated state of the paper passing region heating section 301*a* accurately from the temperature change in the detecting section 301*b* due to energization.

In addition, as the resistance heat generating element 301, one having negative resistance-temperature property (Negative Temperature Coefficient, abbreviated as NTC property) may be used. In the resistance heat generating element 301 having negative resistance-temperature property, electrical resistance decreases as temperature rises. Here, since the resistance heat generating element 301 has the paper passing region heating section 301*a* and the detecting section 301*b*, even though the resistance heat generating element 301 is the heat generating element having the negative resistance-temperature property, it is possible to indirectly detect the overheated state of the paper passing region heating section 301*a* accurately from the temperature change in the detecting section 301*b* due to energization.

Moreover, as the resistance heat generating element 301, one having the positive resistance-temperature property and the negative resistance-temperature property may be used. Here, since the resistance heat generating element 301 has the paper passing region heating section 301*a* and the detecting section 301*b*, even though the resistance heat generating element 301 is the heat generating element having the positive resistance-temperature property and the negative resistance-temperature property, it is possible to indirectly detect the overheated state of the paper passing region heating section 301*a* accurately from the temperature change in the detecting section 301*b* due to energization. The resistance heat generating element 301 having the positive resistance-temperature property and the negative resistance-temperature property is a heat generating element (also referred to as a PTC ceramic heater) which has the negative resistance-temperature property around the normal temperature, and has the positive resistance-temperature property from around a predetermined temperature, and in which when the temperature rises further, a change rate of the electrical resistance is great even with the positive resistance-temperature property.

Figure 6:
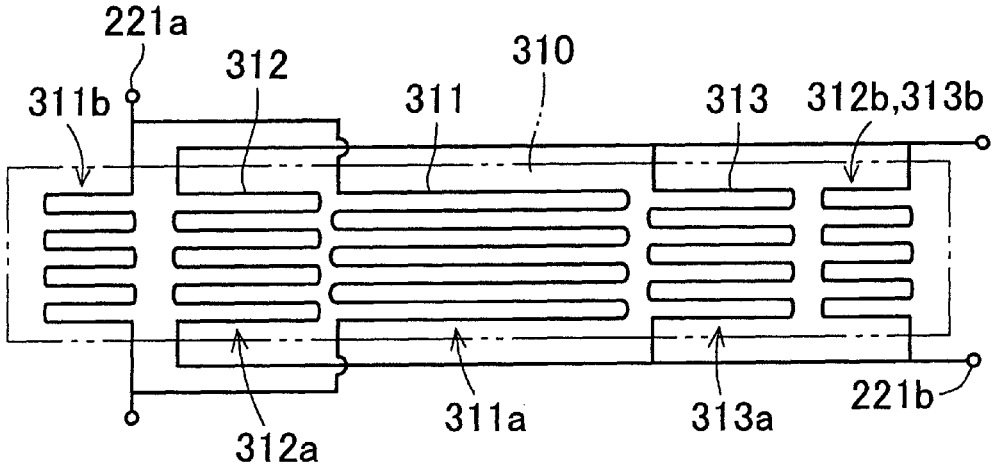
FIG. 6 is a view showing a configuration of a heat generating layer formed by a plurality of resistance heat generating elements.

FIG. 6 is a view showing a configuration of the heat generating layer 310 formed by a plurality of resistance heat generating elements. A heat generating layer of the heat generating member 211 is able to be configured as the heat generating layer 310 whose heat generating part that generates heat due to being energized is divided into more than one. The heat generating layer 310 shown in FIG. 6 is composed of a plurality of resistance heat generating elements 311, 312 and 313. The resistance heat generating elements 311, 312 and 313 repeat a flexion for a plurality of times so as to form a fixed surface as a whole. Then, the heat generating layer 310 is divided into a first heat generating region composed of the paper passing region heating section 312*a* of the resistance heat generating element 312, a second heat generating region composed of the paper passing region heating section 313*a* of the resistance heat generating element 313, and a third heat generating region composed of the paper passing region heating section 311*a* of the resistance heat generating element 311, corresponding to the plurality of regions on the surface of the heat radiating member 210. In the embodiment, assuming a case where the recording paper sheet 32 of different sizes is passed and printing is performed, the surface of the heat radiating member 210 that heats the fixing belt 25 which contacts the recording paper sheet 32 is divided into three regions which are the both end portions and the central portion in the longitudinal direction thereof. Then, the first heat generating region and the second heat generating region of the heat generating layer 310 correspond respectively to the both end portions in the longitudinal direction of the heat radiating member 210, and the third heat generating region corresponds to the central portion in the longitudinal direction of the heat radiating member 210.

The detecting section 312*b* that is electrically connected in parallel with the paper passing region heating section 312*a* of the resistance heat generating element 312, and the detecting section 313*b* that is electrically connected in parallel with the paper passing region heating section 313*a* of the resistance heat generating element 313 are provided on another end portion of the axial direction (longitudinal direction) of the heat generating member 211 corresponding to the non-contact region of the recording paper sheet 32 of the fixing belt 25. Note that, in the embodiment, the detecting section 312*b* and the detecting section 313*b* are common. Furthermore, the detecting section 311*b* that is electrically connected in parallel with the paper passing region heating section 311*a* of the resistance heat generating element 311, is provided on one end portion of the axial direction (longitudinal direction) of the heat generating member 211 corresponding to the non-contact region of the recording paper sheet 32 of the fixing belt 25. Then, the overheat preventing element 40 is respectively provided in a vicinity of the detecting sections 312*b* and 313*b* which are common to the resistance heat generating element 312 and the resistance heat generating element 313, and of the detecting section 311*b* of the resistance heat generating element 311.

The resistance heat generating element 311 is connected to the power feeding terminal section 221*a*, the resistance heat generating element 312 and the resistance heat generating element 313 are connected to the power feeding terminal section 221*b*, and thereby it is possible to energize the respective heat generating regions separately. Whereby, on/off of energization can be switched for the respective resistance heat generating elements 311, 312, and 313 corresponding to the respective divisions of the heat generating part, and the temperature distribution on the surface of the heat radiating member 210 coming into contact with the fixing belt 25 is able to be adjusted to desired temperature distribution. For example, in a case or the like where the recording paper sheet 32 of different dimension, width, or thickness is supplied to the fixing nip region 15*c* to fix the toner image 31, by switching on/off of energization so that only the resistance heat generating element corresponding to a desired specific region on the surface of the heat radiating member 210 generates heat corresponding to the different sizes (dimension, width, or thickness) of the recording paper sheet 32, the surface of the heat radiating member 210 is able to have the desired temperature distribution. Whereby, it is possible to suppress the regional abnormal temperature rise of the resistance heat generating element corresponding to the non-contact part of the recording paper sheet 32 on the surface of the fixing belt 25.

Furthermore, each of the plurality of resistance heat generating elements 311, 312, and 313 has a paper passing region heating section and a detecting section to be electrically connected in parallel. Whereby, it is possible to indirectly detect an overheat state of the paper passing region heating section by the overheat preventing element 40 accurately from the temperature change in the detecting section due to energization for the resistance heat generating elements 311, 312 and 313 corresponding to the respective divisions of the heat generating part. Therefore, it is possible to prevent that the paper passing region heating section of each of the resistance heat generating elements 311, 312, and 313 becomes the overheated state and results in smoke generation or burnout, and high safety is able to be secured.

The configuration of the paper passing region heating section of the resistance heat generating element in a heat generating layer of the heat generating member 211 is not limited to the configuration described above, and it may be configured as follows, for example. Although description will be given specifically using FIGS. 7A and 7B, 8A to 8D, 9A and 9B, and 10A and 10B, the configuration of the heat generating layer shown below shows a modified example of the paper passing region heating section, and the configuration other than that is the same as that of the above-described heat generating layer 212.

Figure 7A:
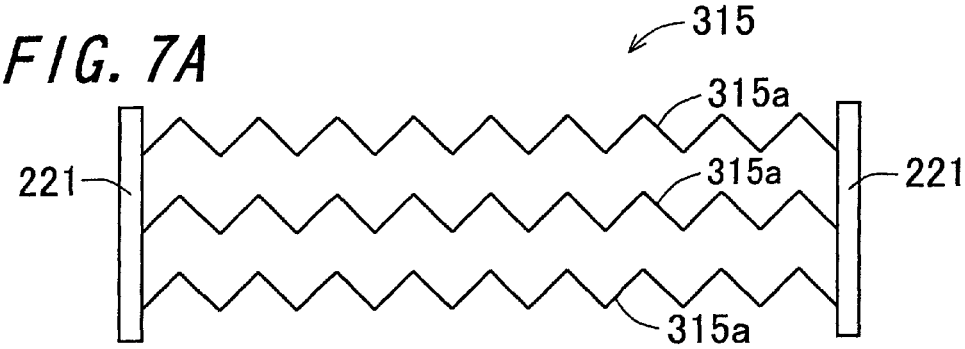
FIGS. 7A and 7B are views showing a divided state of a paper passing region heating section of the resistance heat generating element in the heat generating layer.
Figure 7B:
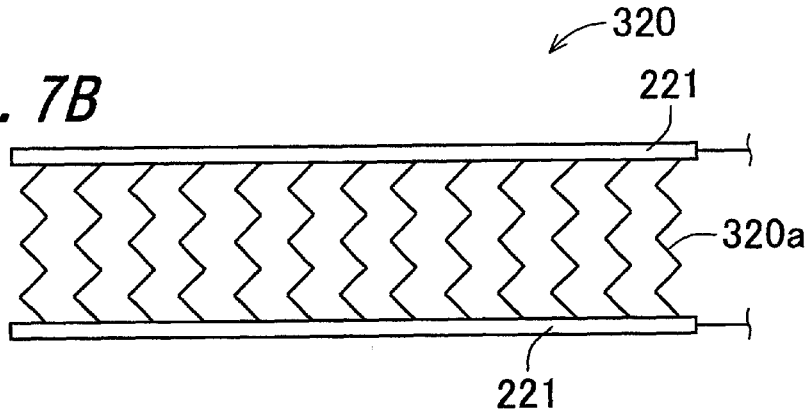

FIGS. 7A and 7B are views showing a divided state of the paper passing region heating section of the resistance heat generating element in the heat generating layer. In the heat generating layer 315 shown in FIG. 7A, paper passing region heating sections 315*a* that correspond to the plurality of resistance heat generating elements extending in the longitudinal direction of the heat radiating member 210 are arrayed so as to be spaced mutually in the circumferential direction (short-side direction) of the heat radiating member 210. Then, when voltage is applied to the power feeding terminal section 221, each of the plurality of paper passing region heating sections 315*a* generate heat separately. That is, a heat generating part on the surface of the heat generating layer 315 becomes a state which is divided in association with each of the paper passing region heating sections 315*a* that generate heat separately. In this manner, heat generated from each of the paper passing region heating sections 315*a* that generate heat separately is transmitted to the heat radiating member 210, and further transmitted from the heat radiating member 210 to the fixing belt 25 so as to heat the fixing belt 25.

Additionally, in the heat generating layer 320 shown in FIG. 7B, paper passing region heating sections 320*a* that correspond to the plurality of resistance heat generating elements extending in the short-side direction of the heat radiating member 210 are arrayed so as to be spaced mutually in the longitudinal direction of the heat radiating member 210. Then, when voltage is applied to the power feeding terminal section 221, each of the plurality of paper passing region heating sections 320*a* generate heat separately.

Figure 8A:
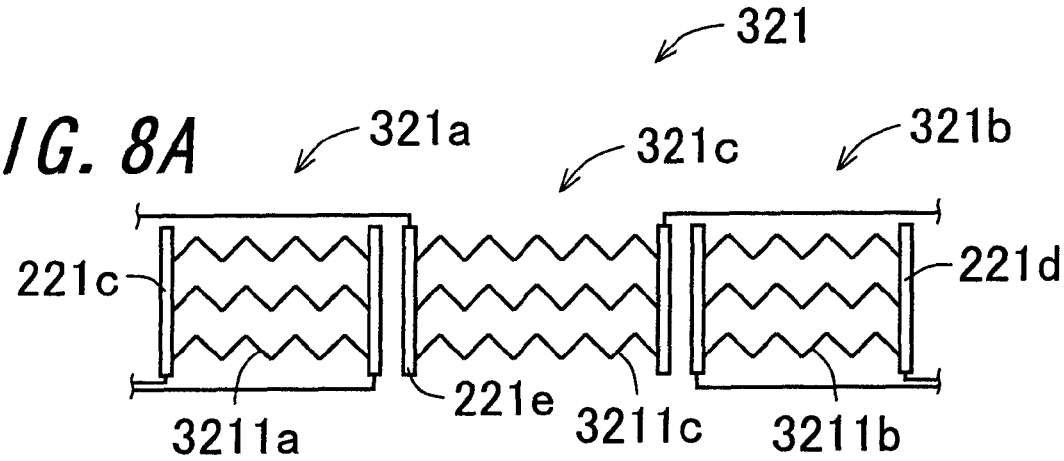
FIGS. 8A to 8D are views showing another example of a divided state of the paper passing region heating section.

FIGS. 8A to 8D are views showing another example of a divided state of the paper passing region heating section. The heat generating layer 321 shown in FIG. 8A is divided into a first heat generating region 321*a*, a second heat generating region 321*b*, and a third heat generating region 321*c*, corresponding to the plurality of regions on the surface of the heat radiating member 210. In the embodiment, assuming a case where the recording paper sheet 32 of different sizes is passed to perform printing, the surface of the heat radiating member 210 that heats the fixing belt 25 which contacts the recording paper sheet 32 is divided into three regions which are both end portions and a central portion in the longitudinal direction thereof. Then, the first heat generating region 321*a* and the second heat generating region 321*b* of the heat generating layer 321 respectively correspond to the both end portions in the longitudinal direction of the heat radiating member 210, and the third heat generating region 321*c* corresponds to the central portion in the longitudinal direction of the heat radiating member 210.

In the first heat generating region 321*a*, paper passing region heating sections 3211*a* that correspond to the plurality of resistance heat generating elements extending in the longitudinal direction of the heat radiating member 210 are provided side by side so as to be spaced mutually in the short-side direction of the heat radiating member 210, and both end portions in the longitudinal direction of each of the paper passing region heating sections 3211*a* are connected to a pair of power feeding terminal sections 221*c*. In the second heat generating region 321*b*, paper passing region heating sections 3211*b* that correspond to the plurality of resistance heat generating elements extending in the longitudinal direction of the heat radiating member 210 are provided side by side so as to be spaced mutually in the short-side direction of the heat radiating member 210, and both end portions in the longitudinal direction of each of the paper passing region heating sections 3211*b* are connected to a pair of power feeding terminal sections 221*d*. In the third heat generating region 321*c*, paper passing region heating sections 3211*c* that correspond to the plurality of resistance heat generating elements extending in the longitudinal direction of the heat radiating member 210 are provided side by side so as to be spaced mutually in the short-side direction of the heat radiating member 210, and both end portions in the longitudinal direction of each of the paper passing region heating sections 3211*c* are connected to a pair of power feeding terminal sections 221*e*.

That is, the respective paper passing region heating sections 3211*a* in the first heat generating region 321*a*, the respective paper passing region heating sections 3211*b* in the second heat generating region 321*b*, and the respective paper passing region heating sections 3211*c* in the third heat generating region 321*c*, are respectively connected to different power feeding terminal sections 221*c*, 221*d*, and 221*e*, and thereby it is possible to energize the respective heat generating regions separately. Whereby, when the recording paper sheet 32 of different sizes is passed to perform printing, in order to obtain desired temperature distribution on the surface of the heat generating layer 321 corresponding to the different passing paper sizes, on/off of the respective heat generating regions 321*a*, 321*b*, and 321*c* is switched to perform sub-control of heating so that only a desired specific region on the surface of the heat generating layer 321 generates heat, and thereby it is possible to suppress the regional abnormal temperature rise of the paper passing region heating section in the heat generating region corresponding to the both end portions of the passing paper width of the recording paper sheet 32. In this way, by switching on/off of energization for the respective divided heat generating regions to perform sub-control of heating, and suppressing the regional abnormal temperature rise of the paper passing region heating section of the resistance heat generating element, fixing failure and degradation in fixed image are able to be prevented as well as the breakage of the resistance heat generating element itself is prevented, and an increase of power consumption is able to be prevented. Moreover, since it is possible to switch on/off of energization of the heat generating region to be divided in association with a region that needs heating on the surface of the fixing belt 25 and perform sub-control of heating for a different operation mode, it is possible to suppress a temperature ripple or sharp lowering of temperature after shifted to an operation mode.

Figure 8B:
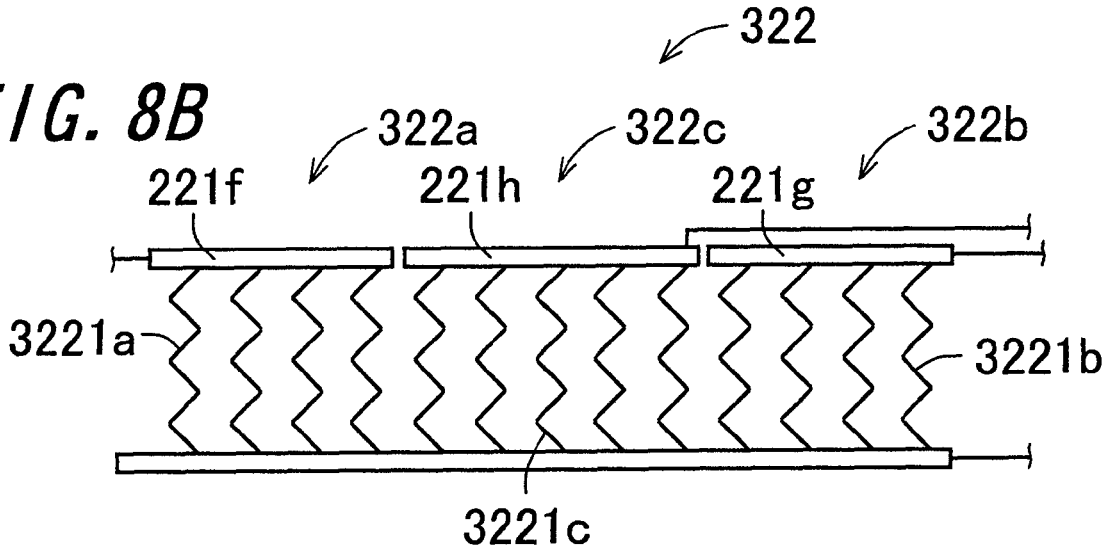

A heat generating layer 322 shown in FIG. 8B is divided into a first heat generating region 322*a*, a second heat generating region 322*b*, and a third heat generating region 322*c*, corresponding to the plurality of regions on the surface of the heat radiating member 210. In the embodiment, assuming a case where the recording paper sheet 32 of different sizes is passed to perform printing, the surface of the heat radiating member 210 that heats the fixing belt 25 which contacts the recording paper sheet 32 is divided into three regions which are both end portions and a central portion in the longitudinal direction thereof. Then, the first heat generating region 322*a* and the second heat generating region 322*b* of the heat generating layer 322 respectively correspond to the both end portions in the longitudinal direction of the heat radiating member 210, and the third heat generating region 322*c* corresponds to the central portion in the longitudinal direction of the heat radiating member 210.

In the first heat generating region 322*a*, paper passing region heating sections 3221*a* that correspond to the plurality of resistance heat generating elements extending in the short-side direction of the heat radiating member 210 are provided side by side so as to be spaced mutually in the longitudinal direction of the heat radiating member 210, and both end portions in the short-side direction of each of the paper passing region heating sections 3221*a* are connected to a pair of power feeding terminal sections 221*f*. In the second heat generating region 322*b*, paper passing region heating sections 3221*b* that correspond to the plurality of resistance heat generating elements extending in the short-side direction of the heat radiating member 210 are provided side by side so as to be spaced mutually in the longitudinal direction of the heat radiating member 210, and both end portions in the short-side direction of each of the paper passing region heating sections 3221*b* are connected to a pair of power feeding terminal sections 221*g*. In the third heat generating region 322*c*, paper passing region heating sections 3221*c* that correspond to the plurality of resistance heat generating elements extending in the short-side direction of the heat radiating member 210 are provided side by side so as to be spaced mutually in the longitudinal direction of the heat radiating member 210, and both end portions in the short-side direction of each of the paper passing region heating sections 3221*c* are connected to a pair of power feeding terminal sections 221*h*.

That is, the respective paper passing region heating sections 3221*a* in the first heat generating region 322*a*, the respective paper passing region heating sections 3221*b* in the second heat generating region 322*b*, and the respective paper passing region heating sections 3221*c* in the third heat generating region 322*c*, are respectively connected to different power feeding terminal sections 221*f*, 221*g*, and 221*h*, and thereby it is possible to energize the respective heat generating regions separately. Whereby, when the recording paper sheet 32 of different sizes is passed to perform printing, in order to obtain the desired temperature distribution on the surface of the heat generating layer 322 corresponding to the different passing paper sizes, on/off of energization is switched for the respective heat generating regions 322*a*, 322*b*, and 322*c* to perform sub-control of heating so that only a desired specific region on the surface of the heat generating layer 322 generates heat, and thus it is possible to suppress the regional abnormal temperature rise of the paper passing region heating section of the resistance heat generating element in the heat generating region corresponding to the both end portions of the passing paper width of the recording paper sheet 32.

Figure 8C:
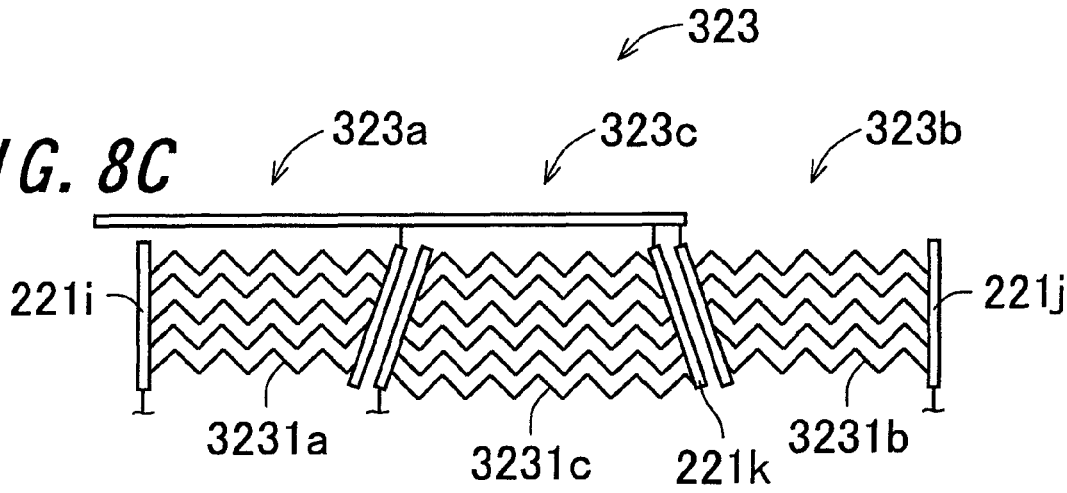

A heat generating layer 323 shown in FIG. 8C is divided into a first heat generating region 323*a*, a second heat generating region 323*b*, and a third heat generating region 323*c*, corresponding to the plurality of regions on the surface of the heat radiating member 210. In the embodiment, assuming a case where the recording paper sheet 32 of different sizes is passed to perform printing, the surface of the heat radiating member 210 that heats the fixing belt 25 which contacts the recording paper sheet 32 is divided into three regions which are both end portions and a central portion in the longitudinal direction thereof. Then, the first heat generating region 323*a* and the second heat generating region 323*b* of the heat generating layer 323 respectively correspond to the both end portions in the longitudinal direction of the heat radiating member 210, and the third heat generating region 323*c* corresponds to the central portion in the longitudinal direction of the heat radiating member 210.

In the first heat generating region 323*a*, paper passing region heating sections 3231*a* that correspond to the plurality of resistance heat generating elements extending in the longitudinal direction of the heat radiating member 210 are provided side by side so as to be spaced mutually in the short-side direction of the heat radiating member 210, and both end portions in the short-side direction of each of the paper passing region heating sections 3231*a* are connected to a pair of power feeding terminal sections 221*i*. At this time, the power feeding terminal section 221*i* on an end portion side is formed as extending in the short-side direction of the heat radiating member 210, and the power feeding terminal section 221*i* on a center side is formed as extending in a direction of inclining at a predetermined angle with respect to the longitudinal direction of the heat radiating member 210. In the second heat generating region 323*b*, paper passing region heating sections 3231*b* that correspond to the plurality of resistance heat generating elements extending in the longitudinal direction of the heat radiating member 210 are provided side by side so as to be spaced mutually in the short-side direction of the heat radiating member 210, and both end portions in the short-side direction of each of the paper passing region heating sections 3231*b* are connected to a pair of power feeding terminal sections 221*j*. At this time, the power feeding terminal section 221*j* on an end portion side is formed as extending in the short-side direction of the heat radiating member 210, and the power feeding terminal section 221*j* on a center side is formed as extending in a direction of inclining at a predetermined angle with respect to the longitudinal direction of the heat radiating member 210. In the third heat generating region 323*c*, paper passing region heating sections 3231*c* that correspond to the plurality of resistance heat generating elements extending in the longitudinal direction of the heat radiating member 210 are provided side by side so as to be spaced mutually in the short-side direction of the heat radiating member 210, and both end portions in the short-side direction of each of the paper passing region heating sections 3231*c* are connected to a pair of power feeding terminal sections 221*k*. At this time, the power feeding terminal sections 221*k* are provided to be parallel with the terminals on the center sides of the power feeding terminal section 221*i* and the power feeding terminal section 221*j*.

That is, the respective paper passing region heating sections 3231*a* in the first heat generating region 323*a*, the respective paper passing region heating sections 3231*b* in the second heat generating region 323*b*, and the respective paper passing region heating sections 3231*c* in the third heat generating region 323*c*, are respectively connected to different power feeding terminal sections 221*i*, 221*j*, and 221*k*, and thereby it is possible to energize the respective heat generating regions separately. Whereby, when the recording paper sheet 32 of different sizes is passed to perform printing, in order to obtain desired temperature distribution on the surface of the heat generating layer 323 corresponding to the different passing paper sizes, on/off of energization is switched for the respective heat generating regions 323*a*, 323*b*, and 323*c* to perform sub-control of heating so that only a desired specific region on the surface of the heat generating layer 323 generates heat, and thus it is possible to suppress the regional abnormal temperature rise of the paper passing region heating section of the resistance heat generating element in the heat generating region corresponding to the both end portions of the passing paper width of the recording paper sheet 32.

Figure 8D:
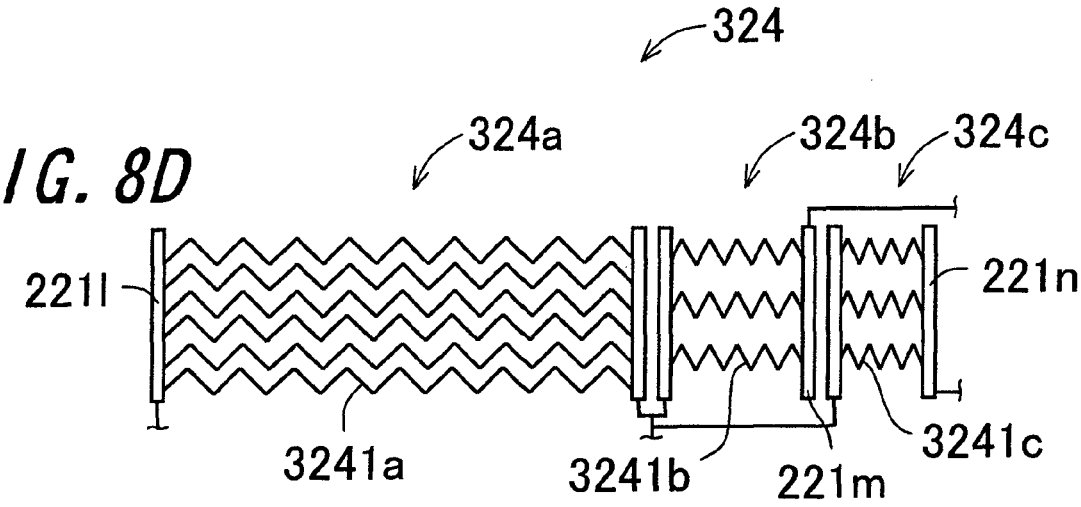

A heat generating layer 324 shown in FIG. 8D is divided into a first heat generating region 324*a*, a second heat generating region 324*b*, and a third heat generating region 324*c*, corresponding to the plurality of regions on the surface of the heat radiating member 210. In the embodiment, the surface of the heat radiating member 210 is divided into three regions which are two regions on an end side in the longitudinal direction thereof and the remaining region. Then, the first heat generating region 324*a* of the heat generating layer 324 corresponds to the remaining region of the heat radiating member 210, and the second heat generating region 324*b* corresponds to a center-side region among two regions on the end side in the longitudinal direction of the heat radiating member 210, and the third heat generating region 324*c* corresponds to an end portion-side region among the two regions on the end side in the longitudinal direction of the heat radiating member 210.

In the first heat generating region 324*a*, paper passing region heating sections 3241*a* that correspond to the plurality of resistance heat generating elements extending in the longitudinal direction of the heat radiating member 210 are provided side by side so as to be spaced mutually in the short-side direction of the heat radiating member 210, and both end portions in the short-side direction of each of the paper passing region heating sections 3241*a* are connected to a pair of power feeding terminal sections 221*l*. In the second heat generating region 324*b*, paper passing region heating section 3241*b* that correspond to the plurality of resistance heat generating elements extending in the longitudinal direction of the heat radiating member 210 are provided side by side so as to be spaced mutually in the short-side direction of the heat radiating member 210, and both end portions in the short-side direction of each of the paper passing region heating sections 3241*b* are connected to a pair of power feeding terminal sections 221*m*. In the third heat generating region 324*c*, paper passing region heating sections 3241*c* that correspond to the plurality of resistance heat generating elements extending in the longitudinal direction of the heat radiating member 210 are provided side by side so as to be spaced mutually in the short-side direction of the heat radiating member 210, and both end portions in the short-side direction of each of the paper passing region heating sections 3241*c* are connected to a pair of power feeding terminal sections 221*n*.

That is, the respective paper passing region heating sections 3241*a* in the first heat generating region 324*a*, the respective paper passing region heating sections 3241*b* in the second heat generating region 324*b*, and the respective paper passing region heating sections 3241*c* in the third heat generating region 324*c*, are respectively connected to different power feeding terminal sections 221*i*, 221*m*, and 221*n*, and thereby it is possible to energize the respective heat generating regions separately. Whereby, in order to obtain desired temperature distribution on the surface of the heat generating layer 324, on/off of energization is switched for the respective heat generating regions 324*a*, 324*b*, and 324*c* and it is possible to perform sub-control of heating so that only a desired specific region on the surface of the heat generating layer 324 generates heat.

In the above embodiments, although descriptions have been given for the divided state of the heat generating part on the surface of the heat generating layer that the paper passing region heating sections corresponding to the plurality of resistance heat generating elements are formed on a same layer, hereinafter, using FIGS. 9A and 9B, description will be given for a divided state of a heat generating part on a surface of a heat generating layer having a layered structure in which a plurality of resistance heat generating elements are layered.

Figure 9A:
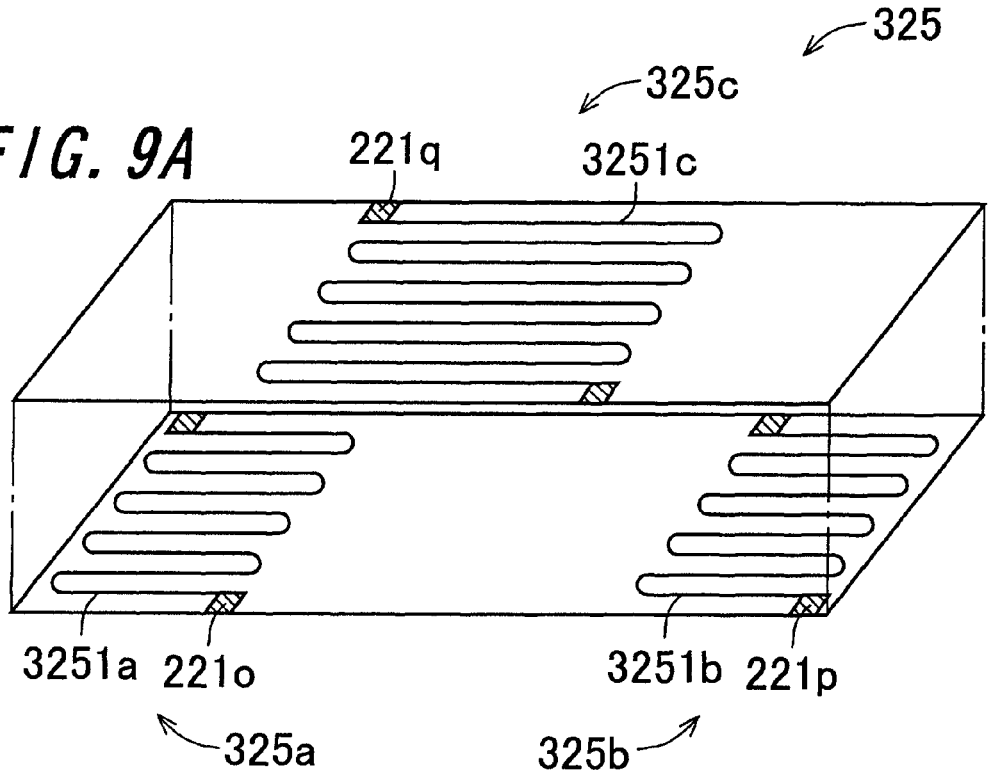
FIGS. 9A and 9B are views showing a divided state of a paper passing region heating section in a heat generating layer having a layered structure in which a plurality of resistance heat generating elements are layered.
Figure 9B:
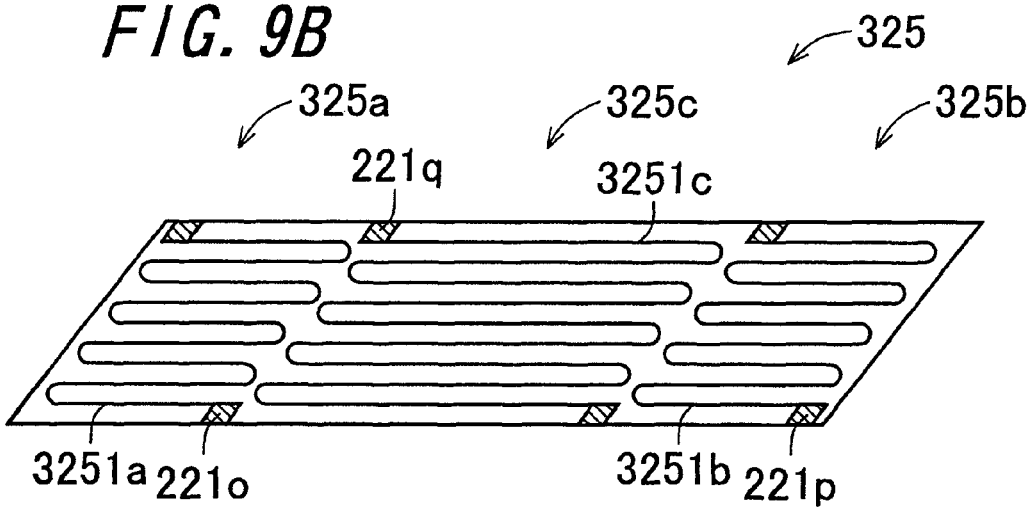

FIGS. 9A and 9B are views showing a divided state of a paper passing region heating section in a heat generating layer having a layered structure in which a plurality of resistance heat generating elements are layered. FIG. 9A shows a configuration of a heat generating layer 325 having a layered structure in which a plurality of resistance heat generating elements are layered, and FIG. 9B shows an arranged state of the paper passing region heating section of each of the resistance heat generating elements in a plan view of the layered structure of the resistance heat generating elements in the heat generating layer 325.

The heat generating layer 325 shown in FIGS. 9A and 9B is formed by laminating a plurality of ceramic sheets having a width of 12 mm corresponding to the circumferential direction of the heat radiating member 325, providing a silver-palladium-based thin-film resistance heating element having a line width of 1 mm on the matching surface of each ceramic sheet so as to reciprocate and turn back 2.5 times by printing, and firing the thin-film resistance heating element. The size of the respective ceramic sheets, and the material, width, thickness, and the turnback pattern at the time of printing of the thin-film resistance heating element are appropriately set in accordance with the necessary heat generation capability of the heat generating layer 325. The heat generating layer 325 including a ceramic heating element laminated with ceramic sheets can be rapidly heated, and even when the heat generating layer 325 itself is in the overheated state, safety is ensured since smoking or firing does not occur while damages occur.

The heat generating layer 325 is divided into a first heat generating region 325*a*, a second heat generating region 325*b*, and a third heat generating region 325*c*, corresponding to the plurality of regions of the surface of the heat radiating member 210. In this embodiment, on the assumption that printing is performed on the recording paper sheets 32 of different sizes, the surface of the heat radiating member 210, which heats the fixing belt 25 in contact with the recording paper sheets 32, is divided into three regions which are both end portions and a central portion in the longitudinal direction thereof. Then, the first heat generating region 325*a* and the second heat generating region 325*b* of the heat generating layer 325 correspond to both end portions in the longitudinal direction of the heat radiating member 210, and the third heat generating region 325*c* corresponds to the central portion in the longitudinal direction of the heat radiating member 210.

The heat generating layer 325 has the layered structure in which the first heat generating region 325*a* and the second heat generating region 325*b* are formed in a same layer, and the third heat generating region 325*c* is formed in another layer. In the first heat generating region 325*a*, a paper passing region heating section 3251*a* that corresponds to the resistance heat generating element extending as a wave-shape in the short-side direction of the heat radiating member 210, and both end portions in the short-side direction of the paper passing region heating section 3251*a* are connected to a pair of power feeding terminal sections 221*o*. In the second heat generating region 325*b*, a paper passing region heating section 3251*b* that corresponds to the resistance heat generating element extending as a wave-shape in the short-side direction of the heat radiating member 210, and both end portions in the short-side direction of the paper passing region heating section 3251*b* are connected to a pair of power feeding terminal sections 221*p*. In the third heat generating region 325*c*, a paper passing region heating section 3251*c* that corresponds to the resistance heat generating element extending as a wave-shape in the short-side direction of the heat radiating member 210, and both end portions in the short-side direction of the paper passing region heating section 3251*c* are connected to a pair of power feeding terminal sections 221*q*.

That is, the paper passing region heating section 3251*a* in the first heat generating region 325*a*, the paper passing region heating section 3251*b* in the second heat generating region 325*b*, and the paper passing region heating section 3251*c* in the third heat generating region 325*c*, are respectively connected to different power supply terminal sections 221*o*, 221*p*, and 221*q*, and thereby it is possible to energize the respective heat generating regions separately. Whereby, when the recording paper sheet 32 of different sizes is passed to perform printing, in order to obtain desired temperature distribution on the surface of the heat generating layer corresponding to the different passing papar sizes, on/off of energization is switched for the respective heat generating regions 325*a*, 325*b*, and 325*c* to perform sub-control of heating so that only a desired specific region on the surface of the heat generating layer 325 generates heat, and thus it is possible to suppress the regional abnormal temperature rise of the paper passing region heating section of the resistance heat generating element in the heat generating region corresponding to the both end portions of the passing paper width of the recording paper sheet 32.

Figure 10A:
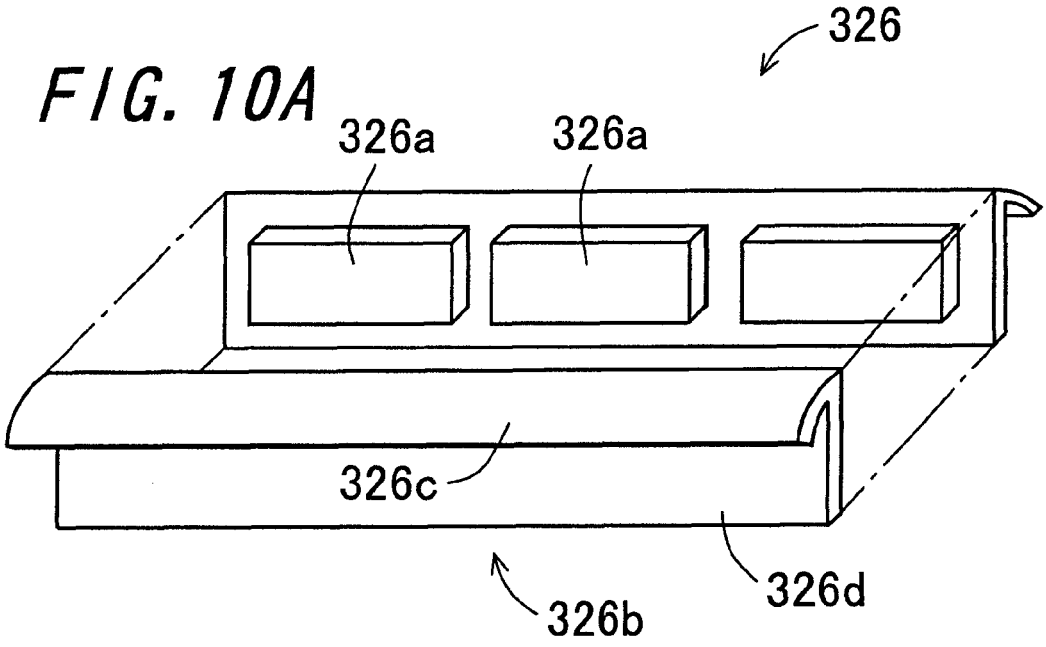
FIGS. 10A and 10B are views showing a configuration of a heating member having a structure in which a plurality of semiconductor ceramic elements are held by a heat radiating member.
Figure 10B:
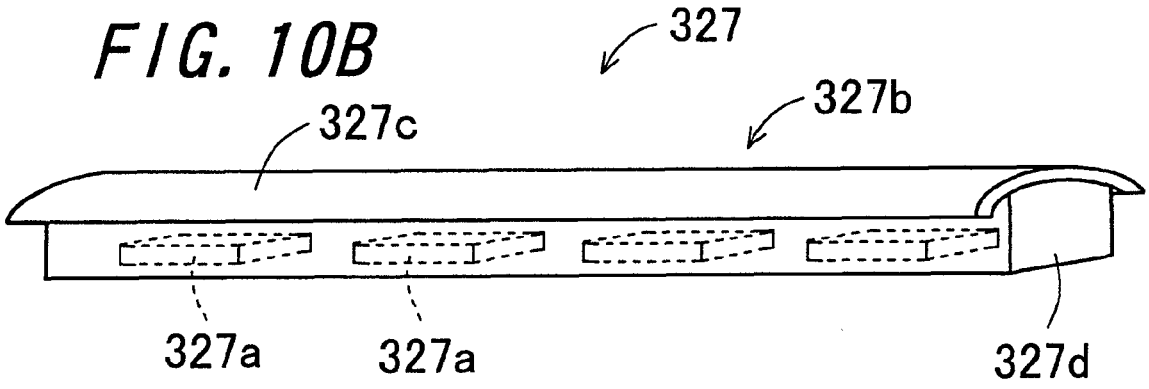

FIGS. 10A and 10B are views showing a configuration of the heating member having a structure in which a plurality of semiconductor ceramic elements are held by a heat radiating member.

A heating member 326 shown in FIG. 10A has a structure in which a plurality of semiconductor ceramic elements 326*a* are sandwiched by two heat radiating members 326*b*. Each of the semiconductor ceramic elements 326*a* is a resistance heat generating element that generates heat due to being energized. In the embodiment, a detecting section of the resistance heat generating element is provided by being electrically connected in parallel with each semiconductor ceramic element 326*a*. Each of the heat radiating members 326*b* has a curved section 326*c* which is curved and a bent section 326*d* which is formed by bending the curved section 326*c* from an end portion of the circumferential direction thereof. In the heating member 326, in a state of sandwiching the semiconductor ceramic elements 326*a* with the bent sections 326*d* of the two heat radiating members 326*b*, the curved sections 326*c* of the two heat radiating members 326*b* are to form a semi-cylinder shape as a whole. Then, the surface of the curved sections 326*c* formed to be a semi-cylinder shape as a whole is a surface of contacting the fixing belt 25. Each of the semiconductor ceramic elements 326*a* is one obtained by molding inorganic powder whose chief component is barium titanate into a thin block shape and firing the molded product. It is possible to obtain the heat generation amount of more than ten watts to hundreds of watts per each of the semiconductor ceramic elements 326*a*.

A heating member 327 shown in FIG. 10B has a structure in which a plurality of semiconductor ceramic elements 327*a* are fit into the heat radiating member 327*b*. Each of the semiconductor ceramic elements 327*a* is a resistance heat generating element that generates heat due to being energized. In the embodiment, a detecting section of the resistance heat generating element is provided by being electrically connected in parallel with each semiconductor ceramic element 327*a*. The heat radiating member 327*b* includes a curved section 327*c* which is curved and formed to be a semi-cylinder shape, and a protruding section 327*d* which protrudes from the inner circumferential surface of the curved section 327*c* and has a recess. In the heating member 327, each of the semiconductor ceramic elements 327*a* is fit into the recess provided in the protruding section 327*d* of the heating member 327*b*. Then, the outer circumferential surface of the curved section 327*c* of the heat radiating member 327*b* is a surface of contacting the fixing belt 25.

Figure 11:
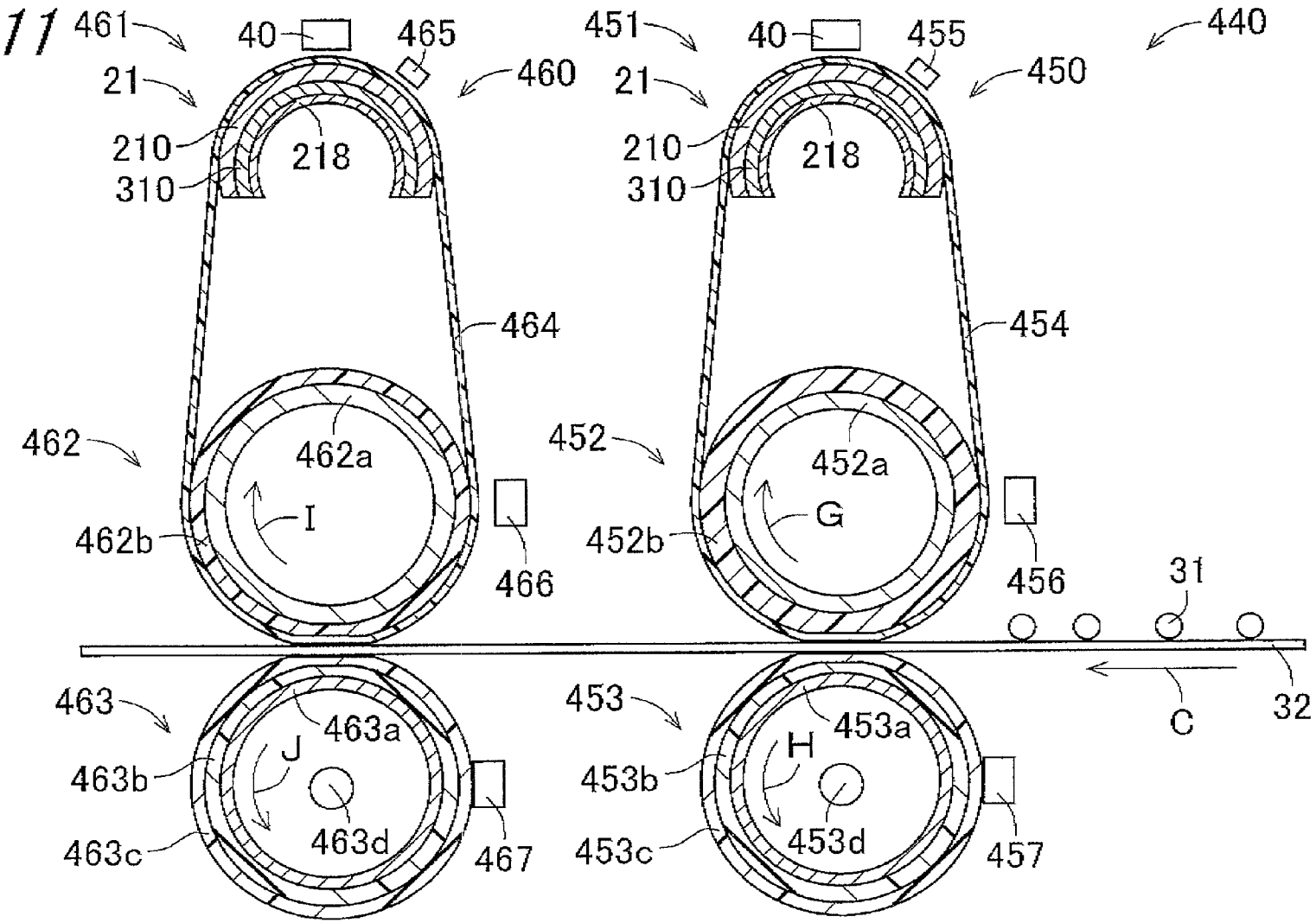
FIG. 11 is a view showing a configuration of a fixing device according to a second embodiment of the invention.

FIG. 11 is a view showing a configuration of a fixing device 440 according to a second embodiment of the invention. The fixing device 440 is a fixing device of two-stage fixing type, and includes a first fixing section 450 that performs primary fixing of an unfixed toner image 31 onto the recording paper sheet 32 under application of heat and pressure, and a second fixing section 460 that is arranged on a downstream side of a conveyance direction of the recording paper sheet 32 with respect to the first fixing section 450 and performs secondary fixing of the toner image 31 after the primary fixing onto the recording paper sheet 32 under application of heat and pressure, and is configured such that the first fixing section 450 and the second fixing section 460 are arranged side by side in a horizontal direction. Then the first fixing section 450 and the second fixing section 460 of the fixing device 440 are the above-described fixing device 15 of the embodiment including the heating member having the heat generating layer composed of the resistance heat generating element configured such that the paper passing region heating section and the detecting section are electrically connected in parallel.

In the fixing device 440 of two-stage fixing type thus configured, when the respective resistance heat generating elements provided in the first fixing section 450 and the second fixing section 460 are energized, temperature changes in the paper passing region heating section and the detecting section of each of the resistance heat generating elements are the same. Therefore, in each of the resistance heat generating elements provided in the first fixing section 450 and the second fixing section 460, the overheated state of the paper passing region heating section is able to be indirectly detected accurately from the temperature change in the detecting section due to energization.

Accordingly, it is possible to accurately detect by the overheat preventing element 40 that at least either one of the paper passing region heating sections of each of the resistance heat generating elements provided in the first fixing section 450 and the second fixing section 460 becomes an overheated state so as to prevent resulting in smoke generation or burnout and high safety is able to be secured.

A guide member such as a conveyance guide plate or a conveying roller, is provided between the first fixing section 450 and the second fixing section 460. The recording paper sheet 32 that is subjected to fixing in the fixing nip region of the first fixing section 450, is conveyed along the guide member, is subjected to fixing in the fixing nip region of the second fixing section 460, and then discharged. The fixing device 440 can be mounted in the image forming apparatus 100, instead of the fixing device 15.

The first fixing section 450 includes a first heating section 451, a first fixing roller 452, a first pressure roller 453, and a first fixing belt 454 which is the same as the above-described fixing belt 25. In the first fixing section 450, the first fixing belt 454 is supported around the first fixing roller 452 and the first heating section 451 with tension, and the first pressure roller 453 is arranged to face the first fixing roller 452 with the first fixing belt 454 interposed therebetween.

The first heating section 451 has the above-described heating member 21. The heating member 21 of the first heating section 451 includes the above-described heat radiating member 210, a heat generating member having the above-described heat generating layer 310 in which the heat generating region is divided into three regions which are the both end portions and the central portion in the longitudinal direction of the heat radiating member 210, and the above-described inside securing member 218.

The heating member 210 in the embodiment is made by curving a metallic thin plate formed of aluminum and having a thickness of 0.5 mm such that a diameter in section is to be 40 mm and an opening angle of an opening section is to be 125°, and contacts the first fixing belt 454 on the outer circumferential surface thereof so as to transmit heat generated by the heat generating layer 310 to the first fixing belt 454.

As described above, the heat generating layer 310 is divided into a first heat generating region 312*a* and a second heat generating region 313*a* corresponding to the both end portions in the longitudinal direction of the heat radiating member 210, and a third heat generating region 311*a* corresponding to the central portion in the longitudinal direction of the heat radiating member 210, and the respective heat generating regions can be energized separately. By controlling energization of the heat generating regions appropriately in accordance with the size or thickness of the recording paper sheet 32, the heat generating layer 310 generates heat. In this embodiment, the heat generating layer 310 generates heat with the amount of heat generation of 1100 W, the amount of heat generation of the third heat generating region 311*a* is 600 W, and the amount of heat generation of each of the first heat generating region 310*a* and the second heat generating region 310*b* is 250 W.

The inside securing member 218, as described above, is configured by a spiral-shaped member formed to be a spiral shape, and holds the heat generating member having the heat generating layer 310 by being in line-contact with a surface side of a thickness direction of the heat generating layer 310 so as to elastically press the heat generating member toward the direction moving closer to the heat radiating member 210 and by allowing another surface side of the thickness direction of the heat generating member 310 to be in surface-contact with the inside surface of the heat radiating member 210.

Further, a first heating element-side thermistor 455 is arranged around the circumferential surface of the first fixing belt 454 wound around the first heating section 451 and detects temperature of the circumferential surface in a non-contact manner.

The first fixing roller 452 comes into pressure-contact with the first pressure roller 453 with the first fixing belt 454 interposed therebetween to form the fixing nip region, and is driven to rotate in a rotation direction G around the rotation axis by a drive motor (not shown), thereby conveying the first fixing belt 454. The first fixing roller 452 has a two-layered structure consisting of a core metal 452*a* and an elastic layer 452*b*, which are formed in this order from inside. For the core metal 452*a*, for example, a metal such as iron, stainless steel, aluminum, or copper, or an alloy thereof is used. In this embodiment, the core metal 452*a* is a member formed of aluminum and having an outer diameter of 40 mm. For the elastic layer 452*b*, a heat resistant rubber material such as silicone rubber or fluorine rubber is appropriately used. In this embodiment, the elastic layer 452*b* is a member formed of silicone foaming sponge having small thermal conductivity and having a thickness of 5 mm. The surface hardness of the first fixing roller 452 thus configured is 68 degrees (Asker C hardness).

Furthermore, a first fixing roller-side thermistor 456 is arranged around the circumferential surface of the winding portion (heating nip region) of the first fixing roller 452, at which the first fixing belt 454 is wound, and detects temperature of the circumferential surface of the first fixing belt 454 wound around the first fixing roller 454 in a non-contact manner.

The first pressure roller 453 is opposite to and in pressure-contact with the first fixing roller 452 with the first fixing belt 454 interposed therebetween, and is driven to rotate in a rotation direction H around the rotation axis by a drive motor (not shown). The first fixing belt 454 and the first fixing roller 452, and the first pressure roller 453 rotate reversely with respect to each other. The first pressure roller 453 has a three-layered structure consisting of a core metal 453*a*, an elastic layer 453*b*, and a release layer 453*c*, which are formed in this order from inside. For the core metal 453*a*, for example, a metal such as iron, stainless steel, aluminum, or copper, or an alloy thereof is used. In this embodiment, the core metal 453*a* is a member formed of aluminum and having an outer diameter of 46 mm. For the elastic layer 453*b*, a heat resistant rubber material such as silicone rubber or fluorine rubber is appropriately used. In this embodiment, the elastic layer 453*b* is a member formed of silicone rubber and having a thickness 2 mm. For the release layer 453*c*, fluorine resin such as PFA (a copolymer of tetrafluoroethylene and perfluoroalkyl vinyl ether) or PTFE (polytetrafluoroethylene), is appropriately used. Further, the release layer 453*c* is a member formed of PFA and having a thickness of about 30 μm. The surface hardness of the first pressure roller 453 thus configured is 75 degrees (Asker C hardness).

Furthermore, a first heater lamp 453*d* (for example, rated power 400 W) is arranged in an interior of the first pressure roller 453 and heats the first pressure roller 453. A control circuit (not shown) causes power to be supplied (energized) from a power supply circuit (not shown) to the first heater lamp 453*d*, the first heater lamp 453*d* emits light, and infrared rays are radiated from the first heater lamp 453*d*. Thus, the inner circumferential surface of the first pressure roller 453 absorbs the infrared rays and is heated, such that the entire first pressure roller 453 is heated. Further, a first pressure roller-side thermistor 457 is arranged on the circumferential surface of the first pressure roller 453 and detects temperature of the circumferential surface of the first pressure roller 453 in a contact manner. Furthermore, an external heater for rapidly heating the surface of the first pressure roller 453, a cleaning roller, and an oil coating roller may be provided in the first pressure roller 453.

The first fixing roller 452 and the first pressure roller 453 have an outer diameter of 50 mm and are in pressure-contact with each other by an elastic member (spring member) (not shown) with a predetermined load (in this case, 600 N). Thus, the fixing nip region is formed between the circumferential surface of the first fixing belt 454 which is supported around the first fixing roller 452 and the first heating section 451, and the circumferential surface of the first pressure roller 453. The fixing nip region refers to a region where the first fixing belt 454 and the first pressure roller 453 come into contact with each other. In this embodiment, the fixing nip region is 9 mm. The first fixing roller 452 is heated to a predetermined temperature (in this case, 180° C.), and the recording paper sheet 32 passes through the fixing nip region, such that the unfixed toner images 31 are heated and molten, and the images are fixed. When the recording paper sheet 32 passes through the fixing nip region, the first fixing belt 454 comes into contact with the toner image forming surface of the recording paper sheet 32, and the first pressure roller 453 comes into contact with the surface of the recording paper sheet 32 opposite to the toner image forming surface.

The recording paper sheet 32 is conveyed to the fixing nip region at a predetermined fixing speed and a copy speed in accordance with the rotation speed of the first fixing roller 452 and the first pressure roller 453, and the unfixed toner images 31 are fixed onto the recording paper sheet 32 under application of heat and pressure. The fixing speed refers to a so-called process speed. In the case of monochrome printing, the fixing speed is 355 mm/sec, and in the case of color printing, the fixing speed is 220 mm/sec. The copy speed refers to the number of copies per minute. In the case of monochrome printing, the copy speed is 70 sheets/minute, and in the case of color printing, the copy speed is 60 sheets/minute.

A web cleaner (not shown) for cleaning the surface of the first fixing belt 454 is arranged in the first fixing section 450.

The control circuit serving as a temperature control section controls energization to the heat generating layer 310 and the first heater lamp 453*d* through the power supply circuit on the basis of temperature data detected by the respective thermistors 455, 456, and 457, such that the heat radiating member 210 of the first heating section 451, the first fixing belt 454, and the first pressure roller 453 are at a predetermined temperature.

Next, the second fixing section 460 will be described. The second fixing section 460 includes a second heating section 461, a second fixing roller 462, a second pressure roller 463, and a second fixing belt 464 which is the same as the above-described fixing belt 25. In the second fixing section 460, the second fixing belt 464 is supported around the second fixing roller 462 and the second heating section 461 with tension, and the second pressure roller 463 is arranged to face the second fixing roller 462 with the second fixing belt 464 interposed therebetween. The second fixing section 460 has the same basic configuration as the first fixing section 450, except that the second heating section 461 is different from the first heating section 451, and the second fixing roller 462 is different from the first fixing roller 452.

The second heating section 461 has the above-described heating member 21. The heating member 21 of the second heating section 461 includes the above-described heat radiating member 210 and a heat generating member having a heat generating layer 310 in which the heat generating region is divided into three regions which are the both end portions and the central portion in the longitudinal direction of the heat radiating member 210 and two regions in the short-side direction of the heat radiating member 210, that is, six regions in total, and the above-described inside securing member 218.

The heat radiating member 210 contacts the second fixing belt 464 on the outer circumferential surface thereof so as to transmit heat generated by the heat generating layer 310 to the second fixing belt 464.

As described above, the heat generating layer 310 is divided into first to six heat generating regions. The first heat generating region and the second heat generating region are both end portions in the longitudinal direction of the heat radiating member 210 and correspond to the downstream side in the rotation direction of the second fixing belt 464. The third heat generating region and the fourth heat generating region are both end portions in the longitudinal direction of the heat radiating member 210 and correspond to the upstream side in the rotation direction of the second fixing belt 464. The fifth heat generating region is the central portion in the longitudinal direction of the heat radiating member 210 and corresponds to the downstream side in the rotation direction of the second fixing belt 464. The sixth heat generating region is the central portion in the longitudinal direction of the heat radiating member 210 and corresponds to the upstream side in the rotation direction of the second fixing belt 464. The respective heat generating regions can be energized separately. By controlling energization of the heat generating regions appropriately in accordance with the size or thickness of the recording paper sheet 32, the heat generating layer 310 generates heat. In this embodiment, the heat generating layer 310 generates heat with the amount of heat amount of 900 W, the amount of heat generation of the fifth heat generating region is 400 W, the amount of heat generation of the sixth heat generating region is 200 W, the amount of heat generation of each of the first heat generating region and the second heat generating region is 100 W, and the amount of heat generation of each of the third heat generating region and the fourth heat generating region is 50 W.

The inside securing member 218, as described above, is configured by a spiral-shaped member formed to be a spiral shape, and holds the heat generating member having the heat generating layer 310 by being in line-contact with a surface side of a thickness direction of the heat generating layer 310 so as to elastically press the heat generating member toward the direction moving closer to the heat radiating member 210 and by allowing another surface side of the thickness direction of the heat generating member 310 to be in surface-contact with the inside surface of the heat radiating member 210.

Further, a second heating element-side thermistor 465 is arranged around the circumferential surface of the second fixing belt 464 wound around the second heating section 461 and detects temperature of the circumferential surface in a non-contact manner.

The second fixing roller 462 comes into pressure-contact with the second pressure roller 463 with the second fixing belt 464 interposed therebetween to form the fixing nip region, and is driven to rotate in a rotation direction I around the rotation axis by a drive motor (not shown), thereby conveying the second fixing belt 464. The second fixing roller 462 has a two-layered structure consisting of a core metal 462*a* and an elastic layer 462*b*, which are formed in this order from inside. For the core metal 462*a*, for example, a metal such as iron, stainless steel, aluminum, or copper, or an alloy thereof is used. In this embodiment, the core metal 462*a* is a member formed of aluminum and having an outer diameter of 46 mm. For the elastic layer 462*b*, a heat resistant rubber material such as silicone rubber or fluorine rubber is appropriately used. In this embodiment, the elastic layer 462*b* is a member formed of silicone rubber and having a thickness of 2 mm. The surface hardness of the second fixing roller 462 thus configured is 68 degrees (Asker C hardness).

Furthermore, a second fixing roller-side thermistor 466 is arranged around the circumferential surface of the winding portion (heating nip region) of the second fixing roller 462, at which the second fixing belt 464 is wound, and detects temperature of the circumferential surface of the second fixing belt 464 wound around the second fixing roller 462 in a non-contact manner.

The second pressure roller 463 is opposite to and in pressure-contact with the second fixing roller 462 with the second fixing belt 464 interposed therebetween, and is driven to rotate in a rotation direction J around the rotation axis by a drive motor (not shown). The second fixing belt 464 and the second fixing roller 462, and the second pressure roller 463 rotate reversely with each other. The second pressure roller 463 has a three-layered structure consisting of a core metal 463*a*, an elastic layer 463*b*, and a release layer 463*c*, which are formed in this order from inside. For the core metal 463*a*, for example, a metal such as iron, stainless steel, aluminum, or copper, or an alloy thereof is used. In this embodiment, the core metal 463*a* is a member formed of aluminum and having an outer diameter of 46 mm. For the elastic layer 463*b*, a heat resistant rubber material such as silicone rubber or fluorine rubber is appropriately used. In this embodiment, the elastic layer 463*b* is a member formed of silicone rubber and having a thickness of 2 mm. For the release layer 463*c*, fluorine resin such as PFA or PTFE is appropriately used. In this embodiment, the release layer 463*c* is a member formed of PFA and having a thickness of about 30 μm. The surface hardness of the second pressure roller 463 thus configured is 75 degrees (Asker C hardness).

Furthermore, a second heater lamp 463*d* (for example, rated power 400 W) for heating the second pressure roller 463 is arranged inside the second pressure roller 463. A control circuit (not shown) causes power to be supplied (energized) from the power supply circuit (not shown) to the second heater lamp 463*d*, the second heater lamp 463*d* emits light, and infrared rays are radiated from the second heater lamp 463*d*. Thus, the inner circumferential surface of the second pressure roller 463 absorbs the infrared rays and is heated, such that the entire second pressure roller 463 is heated. Further, a second pressure roller-side thermistor 467 is arranged on the circumferential surface of the second pressure roller 463 and detects temperature of the circumferential surface of the second pressure roller 463 in a contact manner.

The second fixing roller 462 and the second pressure roller 463 have an outer diameter of 50 mm and are in pressure-contact with each other by an elastic member (spring member) (not shown) with a predetermined load (in this case, 550 N). Thus, the fixing nip region is formed between the circumferential surface of the second fixing belt 464 which is supported around the second fixing roller 462 and the second heating section 461, and the circumferential surface of the second pressure roller 463. The fixing nip region refers to a portion where the second fixing belt 464 and the second pressure roller 463 come into contact with each other. In this embodiment, the fixing nip region is 8 mm.

The control circuit serving as a temperature control section controls energization to the heat generating layer 310 and the second heater lamp 463*d* through the power supply circuit on the basis of temperature data detected by the respective thermistors 465, 466, and 467, such that the heat radiating member 210 of the second heating section 461, the second fixing belt 464, and the second pressure roller 463 are at a predetermined temperature.

In the above-described fixing device 440 including the first fixing section 450 and the second fixing section 460, as described in Japanese Unexamined Patent Publication JP-A 2005-352389, control is performed such that the temperature of the second fixing section 460 is controlled so as to compensate for the changes in temperature of the first fixing section 450 (gloss compensation mode), whereby substantially uniform image gloss is obtained when the sheet passes successively therethrough (successive fixing processing).

First, the relational expression about temperature between the first fixing belt 454 and the second fixing belt 464 is calculated in advance such that a plurality of output images have substantially uniform gloss. That is, the temperature of the second fixing belt 464 is controlled so as to be at temperature calculated by the relational expression with respect to the change in temperature of the first fixing belt 454, such that images with uniform gloss are obtained, regardless of the temperature of the first fixing roller 452.

The temperature control section of the first fixing section 450 calculates the difference (T1-T2) between the surface temperature T1 of the first fixing belt 454 detected by the first fixing roller-side thermistor 456 and a target temperature set value T2 of the first fixing belt 454 as a temperature change value a of the first fixing belt 454. When the temperature change value a exceeds a temperature ripple for temperature control of the first fixing belt 454 when the sheet does not pass therethrough, control by the gloss correction temperature control mode is performed. When a target set temperature of the second fixing belt 464 is referred to as T4, in the gloss correction temperature control mode, temperature control of the second fixing belt 464 is performed by means of a value (T4+β), which is obtained by adding a temperature correction value β of the second fixing belt 464 to the target set temperature T4 of the second fixing belt 464. The temperature control section of the second fixing section 460 substitutes the surface temperature (T2+α) of the first fixing belt 454 into the relational expression to calculate the control temperature (T4+β) of the second fixing belt 464 and then performs temperature control. The gloss correction temperature control mode ends when the successive fixing processing ends or when the temperature change value α of the first fixing belt 454 is equal to or lower than a predetermined value, and control by the normal mode is carried out.

Figure 12:
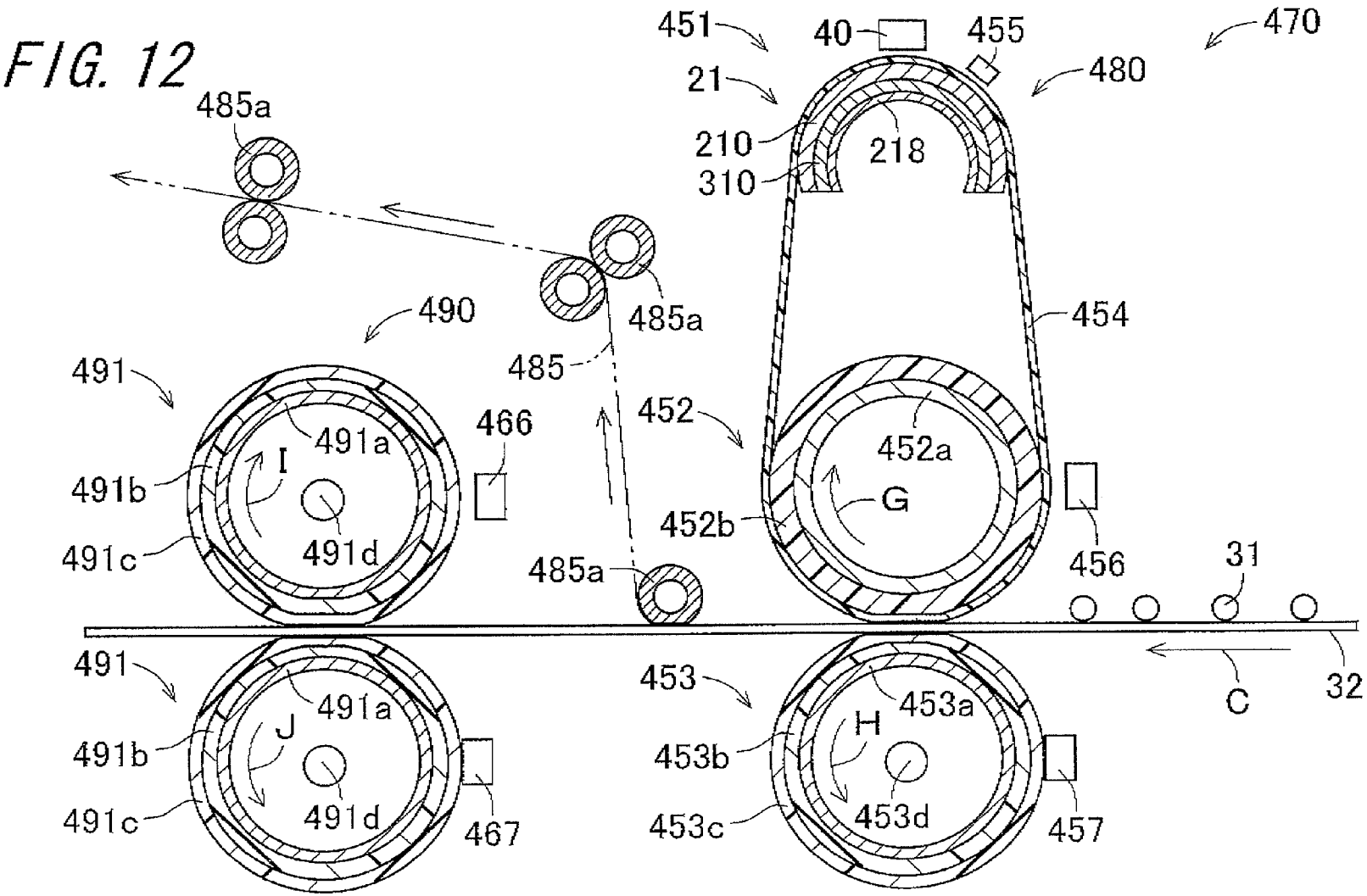
FIG. 12 is a view showing a configuration of a fixing device according to a third embodiment of the invention.

FIG. 12 is a view showing a configuration of a fixing device 470 according to a third embodiment of the invention. The fixing device 470 is a fixing device of two-stage fixing type, and includes a first fixing section 480 that performs primary fixing of an unfixed toner image 31 onto the recording paper sheet 32 under application of heat and pressure, and a second fixing section 490 that performs secondary fixing of the toner image 31 after the primary fixing onto the recording paper sheet 32 under application of heat and pressure, the second fixing section 490 being configured by a pair of heating and pressure rollers 491 that are provided with a heating section in an interior thereof, and are in pressure-contact with each other, and being arranged on a downstream side of a conveyance direction of the recording paper sheet 32 with respect to the first fixing section 480. The fixing device 470 is configured such that the first fixing section 480 and the second fixing section 490 are arranged side by side in a horizontal direction. Then the first fixing section 480 of the fixing device 470 is the above-described fixing device 15 of the embodiment including the heating member having the heat generating layer composed of the resistance heat generating element configured such that the paper passing region heating section and the detecting section are electrically connected in parallel.

In the fixing device 470 of two-stage fixing type thus configured, when the respective resistance heat generating elements provided in the first fixing section 480 are energized, temperature changes in the paper passing region heating section and the detecting section of each of the resistance heat generating elements are the same. Therefore, in each of the resistance heat generating elements provided in the first fixing section 480, the overheated state of the paper passing region heating section is able to be indirectly detected accurately from the temperature change in the detecting section due to energization. Accordingly, it is possible to accurately detect by the overheat preventing element 40 that the paper passing region heating section of the resistance heat generating element provided in the first fixing section 480 becomes an overheated state so as to prevent resulting in smoke generation or burnout, and high safety is able to be secured. Furthermore, although the first fixing section 480 and the second fixing section 490 are fixing sections whose heating methods are different from each other, it is possible to detect the overheated state safely without occurrence of problems such as detection of only one of the fixing sections is difficult, or the detection is performed slowly.

A guide member such as a conveyance guide plate or a conveying roller, is provided between the first fixing section 480 and the second fixing section 490. The recording paper sheet 32 that is subjected to fixing in the fixing nip region of the first fixing section 480, is conveyed along the guide member, is subjected to fixing in the fixing nip region of the second fixing section 490, and then discharged. The fixing device 470 can be mounted in the image forming apparatus 100, instead of the fixing device 15.

The first fixing section 480 provided in the fixing device 470 has the same configuration as the first fixing section 450 provided in the fixing device 440 described above, and thus description thereof will not be repeated. The second fixing section 490 provided in the fixing device 470 is a fixing section of roller fixing type, in which the pair of heating and pressure rollers 491 are in pressure-contact with each other to form the fixing nip region. The rollers are driven to rotate reversely with respect to each other.

The pair of heating and pressure rollers 491 have a three-layered structure consisting of a core metal 491*a*, an elastic layer 491*b*, and a release layer 491*c*, which are formed in this order from inside. For the core metal 491*a*, for example, a metal such as iron, stainless steel, aluminum, or copper, or an alloy thereof is used. For the elastic layer 491*b*, a heat resistant rubber material such as silicone rubber or fluorine rubber is appropriately used. For the release layer 491*c*, fluorine resin such as PFA or PTFE is appropriately used.

Further, each of the pair of heating and pressure rollers 491 is provided with a heater lamp 491*d* in an interior thereof to heat the corresponding heating and pressure roller 491. A control circuit (not shown) causes power to be supplied (energized) from a power supply circuit (not shown) to the heater lamps 491*d*, the heater lamps 491*d* emit light, and infrared rays are radiated from the heater lamps 491*d*. Thus, the inner circumferential surfaces of the heating and pressure rollers 491 absorb the infrared rays and are heated, such that the entire heating and pressure rollers 491 are heated. The configuration for heating the heating and pressure rollers 491 is not limited to that described above, an induction heating method using induction heating may be used or a heater lamp and an induction heating method may be appropriately combined.

In the above-described fixing device 470 including the first fixing section 480 and the second fixing section 490, the first fixing section 480 has a mechanism that is capable of carrying out rapid heating, and the second fixing section 490 has a large heat capacity.

In the fixing device 470 thus configured, the first fixing section 480 is warmed up in advance. Then, when rising is satisfactory, and a copy operation should be rapidly carried out, after the recording paper sheet 32 passes through the fixing nip region of the first fixing section 480 and is subjected to fixing, the recording paper sheet 32 is conveyed to a bypass route 485 through the guide member and discharged by a plurality of conveying rollers 485*a* provided in the bypass route 485. In this case, the recording paper sheet 32 is subjected to fixing only by the first fixing section 480. When the recording paper sheet 32 is thin paper, in the same manner as described above, fixing may be carried out only by the first fixing section 480.

Meanwhile, when the recording paper sheet 32 is thick paper, to improve image gloss or to improve the fixing speed, the recording paper sheet 32 which is subjected to fixing in the fixing nip region of the first fixing section 480, may be conveyed along the guide member and further subjected to fixing in the fixing nip region of the second fixing section 490. As described above, by carrying out fixing in the fixing nip regions of the first fixing section 480 and the second fixing section 490, fixing performance and image gloss can be improved.

Figure 13:
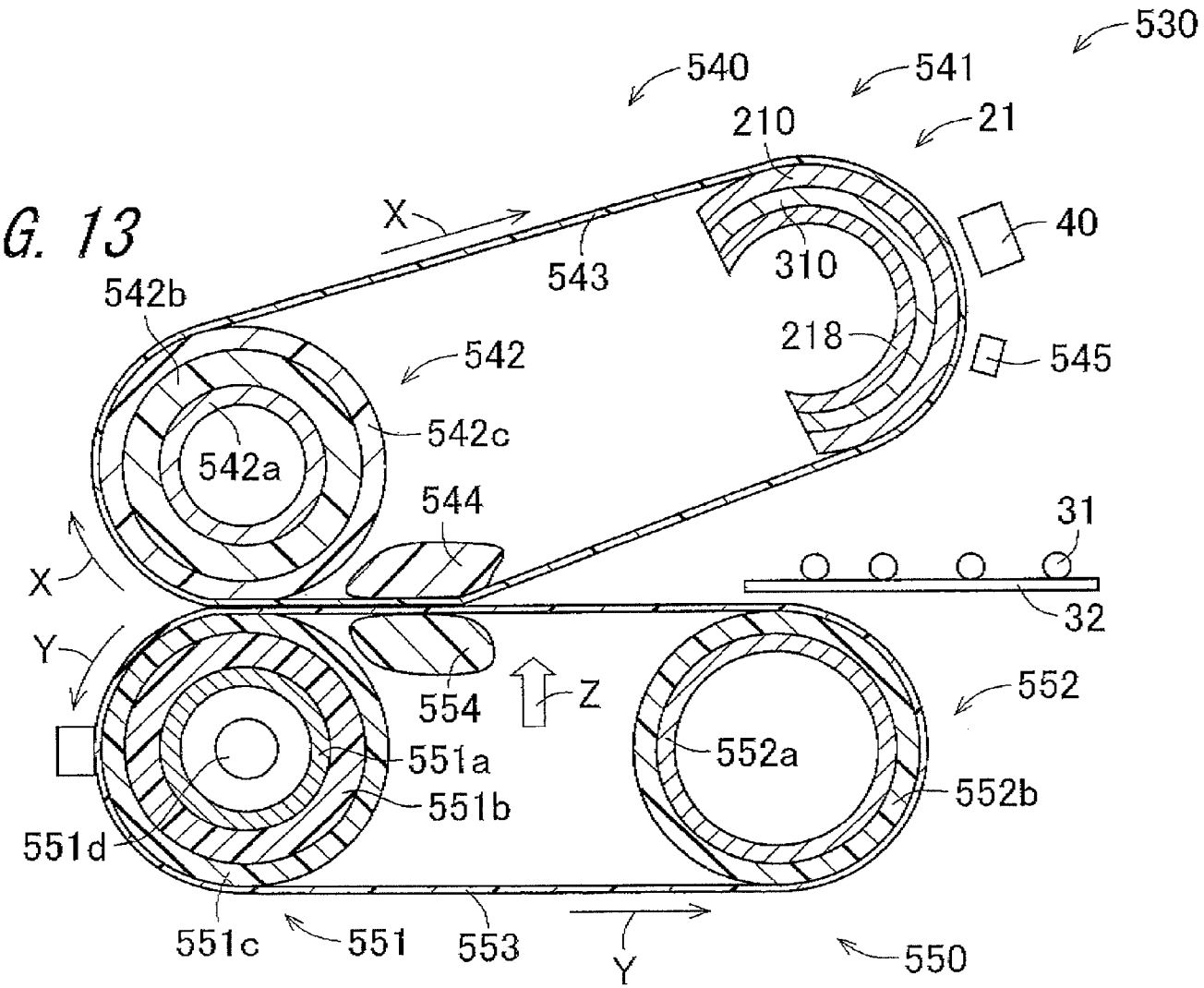
FIG. 13 is a view showing a configuration of a fixing device according to a fourth embodiment of the invention.

FIG. 13 is a view showing the configuration of a fixing device 530 according to a fourth embodiment of the invention. The fixing device 530 includes a fixing section 540 and a pressure section 550. The fixing device 530 carries out fixing onto the recording paper sheet 32, on which the unfixed toner images 31 are borne, in the fixing nip region which is formed between the fixing section 540 and the pressure section 550. The fixing device 530 can be mounted in the image forming apparatus 100, instead of the fixing device 15.

The fixing section 540 includes a heating section 541, a fixing roller 542, and a fixing belt 543 which is an endless-shaped belt. In the fixing section 540, the fixing belt 543 is supported around the fixing roller 542 and the heating section 541 with tension.

The heating section 541 has the above-described heating member 21. The heating member 21 of the heating section 541 includes the above-described heat radiating member 210, the heat generating member having the heat generating layer 310, and the inside securing member 218. The heat radiating member 210 contacts the fixing belt 543 on the outer circumferential surface thereof so as to transmit heat generated by the heat generating layer 310 to the fixing belt 543. The heat generating layer 310 is composed of the resistance heat generating element in which the paper passing region heating section and the detecting section are electrically connected in parallel, as described above.

The inside securing member 218 is configured by a spiral-shaped member formed to be a spiral shape, and holds the heat generating member having the heat generating layer 310 by being in line-contact with a surface side of a thickness direction of the heat generating layer 310 so as to elastically press the heat generating member toward the direction moving closer to the heat radiating member 210 and by allowing another surface side of the thickness direction of the heat generating layer 310 to be in surface-contact with the inside surface of the heat radiating member 210. Furthermore, a heat generating element-side thermistor 545 is arranged around the circumferential surface of the fixing belt 543 wound around the heating section 541 and detects temperature of the circumferential surface in a non-contacting manner.

The fixing roller 542 is a roller-like member having an outer diameter of 30 mm, which is driven to rotate in a rotation direction X around the rotation axis by a drive motor (not shown), thereby conveying the fixing belt 543. The fixing roller 542 has a three-layered structure consisting of a core metal 542*a*, an elastic layer 542*b*, and a surface layer 542*c*, which are formed in this order from inside. For the core metal 542*a*, for example, a metal having high thermal conductivity such as iron, stainless steel, aluminum, or copper, or an alloy thereof is used. Although examples of the shape of the core metal 542*a* include a cylinder and a column, the shape of the core metal 542*a* is preferably a cylinder since the amount of heat generation is small. For the elastic layer 542*b*, a heat resistant rubber material such as silicone rubber, fluorine rubber, or fluorosilicone rubber, is appropriately used. Among them, silicone rubber is preferably used which is excellent in rubber elasticity.

The material for the surface layer 542*c* is not particularly limited insofar as heat resistance and durability are excellent and slidability is high. For example, a fluorine-based resin material such as PFA or PTFE, or fluorine rubber may be used. Alternatively, a two-layered structure with no surface layer may be provided. The fixing roller 542 may be provided with a heating section for heating the fixing roller 542 in an interior thereof. This is to reduce the rising time from when the image forming apparatus 100 is powered-on until image formation is possible, and to suppress a decrease in the surface temperature of the fixing roller 542 due to heat transfer to the recording paper sheet 32 at the time of toner image fixing.

The fixing belt 543 is heated to a predetermined temperature by the heating section 541, and comes into contact with the fixing belt 543 to heat the conveyed recording paper sheet 32 on which the unfixed toner images 31 are formed. The fixing belt 543, which is an endless-shaped belt, is supported around the heating section 541 and the fixing roller 542, and wound around the fixing roller 542 at a predetermined angle. When the fixing roller 542 rotates, the fixing belt 543 is driven by rotation of the fixing roller 542 and rotates in the rotation direction X. The fixing belt 543 is provided to come into contact with a pressure belt 553 in a pressure-contact region between the fixing roller 542 and a pressure roller 551 described below.

The fixing belt 543 is an endless-shaped belt that has a three-layered structure consisting of a substrate layer, an elastic layer, and a release layer. The fixing belt 543 is formed to have a cylindrical shape of a diameter of 60 mm and a thickness of 270 μm. The material for the substrate layer is not particularly limited insofar as heat resistance and durability are excellent, and heat resistant synthetic resins may be used. Among them, polyimide (PI) or polyamide-imide resin (PAI) is preferably used. These resins have high strength and high heat resistance as well as are inexpensive. The thickness of the substrate layer is not particularly limited, and is preferably in a range of 30 to 200 μm. In this embodiment, the substrate layer is made of polyimide and has a thickness of 100 μm.

The material for the elastic layer is not particularly limited insofar as the material has rubber elasticity, and preferably the material is also excellent in heat resistance. Specific examples of such a material include, silicone rubber, fluorine rubber, and fluorosilicone rubber. Among them, silicone rubber, which is excellent in rubber elasticity and has satisfactory heat resistance, is preferably used. The surface hardness of the elastic layer is preferably in a range of 1 to 60 degrees based on the JIS-A hardness scale. When the surface hardness of the elastic layer is within this range based on the JIS-A hardness scale, deterioration of the strength of the elastic layer and defective adhesion can be prevented, and defective fixability of toner can be prevented. Specific examples of silicone rubber having such properties include one-component, two-component, or three or more-component silicone rubber, LTV, RTV, or HTV-type silicone rubber, and condensation or addition-type silicone rubber. The thickness of the elastic layer is preferably in a range of 30 to 500 μm. When the thickness of the elastic layer is within this range, the elastic effect of the elastic layer can be maintained, and thermal insulation can be minimized, thereby achieving power savings. In this embodiment, the elastic layer is made of silicone rubber having hardness of 5 degrees based on the JIS-A hardness scale and a thickness of 150 μm.

The release layer is made of a fluorine resin tube. The release layer formed on the outer circumference of the fixing belt 543 is made of a fluorine resin. Thus, the release layer is excellent in durability, as compared with a release layer which is formed by applying and baking resin containing fluorine resin. When a release layer is formed by application and baking, an accurate and expensive mold is required so as to a release layer with high dimension accuracy. Meanwhile, when a tube is used, a release layer with high dimension accuracy is obtained, even without using the above-described mold. The thickness of the release layer is preferably in a range of 5 to 50 μm. When the thickness of the release layer is within this range, the release layer can follow fine irregularities of the recording paper sheet 32 while having appropriate strength and ensuring elasticity of the elastic layer. In this embodiment, for the release layer, a PTFE tube having a thickness of about 20 μm is used.

Next, the pressure section 550 will be described. The pressure section 550 includes a pressure roller 551, a tension roller 552, and a pressure belt 553 which is an endless-shaped belt. In the pressure section 550, the pressure belt 553 is supported around the pressure roller 551 and the tension roller 552 with tension. The pressure roller 551 and the tension roller 552 are rotatably supported between left and right side plates (not shown) of the fixing device 530.

The pressure belt 553 is configured in the same manner as the above-described fixing belt 543, and rotates by rotation of the fixing belt 543 being in contact therewith.

The pressure roller 551 is a roller-like member that is rotated in a rotation direction Y around the rotation axis by rotation of the pressure belt 553 which is rotated by rotation of the fixing belt 543. The pressure roller 551 has an outer diameter of 30 mm. The pressure roller 551 has a three-layered structure consisting of a core metal 551*a*, an elastic layer 551*b*, and a surface layer 551*c*, which are formed in this order from inside. As the materials for the core metal 542*a*, the elastic layer 551*b*, and the surface layer 551*c* of the pressure roller 551, the same materials as those for the core metal 542*a*, the elastic layer 542*b*, and the surface layer 542*c* of the above-described fixing roller 542 may be used. The pressure roller 551 is provided with a heating section 551*d* for heating the pressure roller 551 in an interior thereof. This is to reduce the rising time from when the image forming apparatus 100 is powered-on until image formation is possible, and to suppress a rapid decrease in the surface temperature of the pressure roller 551 due to heat transfer to the recording paper sheet 32 at the time of toner image fixing. In this embodiment, for the heating section 551*d*, a halogen lamp is used.

The tension roller 552 is configured such that a silicone sponge layer 552*b* is provided on an iron-alloy core metal 552*a* having an outer diameter of 30 mm and an inner diameter of 26 mm so as to decrease thermal conductivity, thereby decreasing thermal conduction from the pressure belt 553.

The fixing device 530 is a so-called twin-belt fixing type fixing device in which the fixing nip region is formed at a region where the fixing belt 543 and the pressure belt 553 come into contact with each other, and fixing is carried out in the fixing nip region. In the fixing device 530, the pressure-contact region where the fixing roller 542 and the pressure roller 551 come into pressure-contact with each other with the fixing belt 543 and the pressure belt 553 interposed therebetween becomes the lowermost stream portion of the fixing nip region. Of the entire fixing nip region formed at the portion where the fixing belt 543 and the pressure belt 553 are in contact with each other, the lowermost stream portion is a portion where the pressure distribution in the conveyance direction of the recording paper sheet becomes the maximum. As described above, by making the configuration such that the pressure distribution at the lowermost stream portion of the fixing nip region becomes the maximum, the fixing belt 543 and the pressure belt 553 can be prevented from slipping at the time of rotation.

The fixing device 530 is also provided with a fixing pad 544 and a pressure pad 554 so as to ensure a wide fixing nip region, without increasing the size of the device. The fixing pad 544 serves as a first pressure pad that presses the fixing belt 543 toward the pressure belt 553. The pressure pad 554 serves a second pressure pad that presses the pressure belt 553 toward the fixing belt 543. The fixing pad 544 and the pressure pad 554 are arranged to be supported between left and right side plates (not shown) of the fixing device 530. The pressure pad 554 is pressed toward the fixing pad 544 with a predetermined pressing force in a direction Z close to the fixing pad 544 by a pressing mechanism (not shown). As the materials for the fixing pad 544 and the pressure pad 554, PPS (polyphenylene sulfide resin) may be used.

When the fixing nip region is formed by the fixing pad 544 and the pressure pad 554 which are not rotators, the inner circumferential surfaces of the fixing belt 543 and the pressure belt 553 frictionally slide on the respective pads. Then, when the friction coefficient between the inner circumferential surfaces of the respective belts 543 and 553 and the respective pads 544 and 554 increases, slide resistance increases. As a result, image slippage, gear damages, an increase in power consumption of the drive motor, and the like occur. In particular, in the twin-belt system, these problems become conspicuous. For this reason, low friction sheet layers are provided on the contact surfaces of the fixing pad 544 and the pressure pad 554 with the respective belts 543 and 553. Therefore, the respective pads 544 and 554 can be prevented from being abraded due to friction to the respective belts 543 and 553, and slide resistance can be reduced. As a result, satisfactory belt running property and durability are obtained.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A fixing device comprising:

a first fixing member;

a heating member;

a fixing belt that forms an endless-shaped belt member supported around the first fixing member and the heating member with tension to be rotatable, and comes into contact with the heating member to be heated; and a second fixing member that forms a fixing nip region together with the fixing belt, the fixing device fixing a toner image borne on a recording medium onto the recording medium in the fixing nip region under application of heat and pressure, the heating member including:

a curved heat radiating member having an outer circumferential surface in contact with the fixing belt; and a heat generating member having a heat generating layer composed of a resistance heat generating element that generates heat due to being energized and arranged to be in contact with an inside surface of the heat radiating member, the resistance heat generating element including:

a paper passing region heating section forming a heat generating source part for heating a paper passing region of the fixing belt where the recording medium contacts and passes in the fixing nip region; and a detecting section that is provided to correspond to a paper non-contacting region of the recording medium of the fixing belt and connected electrically in parallel with the paper passing region heating section, the paper passing region heating section and the detecting section have an equivalent power density, and the fixing device further comprising an overheat preventing element that is provided in a vicinity of the detecting section and suppresses energization to the resistance heat generating element when temperature of the detecting section reaches a predetermined value.

2. The fixing device of claim 1, wherein the resistance heat generating element is configured to form a surface of a fixed shape as a whole.

3. The fixing device of claim 1, wherein the resistance heating element is a ceramic heating element.

4. The fixing device of claim 1, wherein the resistance heating element has a positive resistance-temperature property in which, as temperature rises, electrical resistance increases.

5. The fixing device of claim 1, wherein the resistance heating element has a negative resistance-temperature property in which, as temperature rises, electrical resistance decreases.

6. The fixing device of claim 1, wherein the resistance heating element has a positive resistance-temperature property and a negative resistance-temperature property.

7. The fixing device of claim 1, wherein the second fixing member includes a pressure belt that is an endless-shape belt member supported around a pressure member and a supporting member with tension so as to be rotatable, and the pressure member is provided to face the first fixing member with the fixing belt and the pressure belt interposed therebetween.

8. A fixing device of two-stage fixing type, comprising:

a first fixing section that performs primary fixing of a toner image borne on a recording medium to be conveyed onto the recording medium under application of heat and pressure; and a second fixing section that is arranged on a downstream side of a conveyance direction of the recording medium with respect to the first fixing section, and performs secondary fixing of the toner image after the primary fixing onto the recording medium under application of heat and pressure, the first fixing section and the second fixing section being the fixing device of claim 1.

9. An image forming apparatus including the fixing device of claim 8.

10. A fixing device of two-stage fixing type, comprising:

a first fixing section that performs primary fixing of a toner image borne on a recording medium to be conveyed onto the recording medium under application of heat and pressure; and a second fixing section that performs secondary fixing of the toner image after the primary fixing onto the recording medium under application of heat and pressure, the second fixing section being configured by a pair of heating and pressure rollers that are provided with a heating section in an interior thereof, and are in pressure-contact with each other, and being arranged on a downstream side of a conveyance direction of the recording medium with respect to the first fixing section, and the first fixing section being the fixing device of claim 1.

11. An image forming apparatus including the fixing device of claim 10.

12. An image forming apparatus including the fixing device of claim 1.

13. A fixing device comprising:

a first fixing member;

a heating member;

a fixing belt that forms an endless-shaped belt member supported around the first fixing member and the heating member with tension to be rotatable, and comes into contact with the heating member to be heated; and a second fixing member that forms a fixing nip region together with the fixing belt, the fixing device fixing a toner image borne on a recording medium onto the recording medium in the fixing nip region under application of heat and pressure, the heating member including:

a curved heat radiating member having an outer circumferential surface in contact with the fixing belt; and a heat generating member having a heat generating layer composed of a resistance heat generating element that generates heat due to being energized and arranged to be in contact with an inside surface of the heat radiating member, the resistance heat generating element including:

a paper passing region heating section forming a heat generating source part for heating a paper passing region of the fixing belt where the recording medium contacts and passes in the fixing nip region; and a detecting section that is provided to correspond to a paper non-contacting region of the recording medium of the fixing belt and connected electrically in parallel with the paper passing region heating section, the paper passing region heating section and the detecting section having an equivalent temperature rising speed in generating heat due to being energized, and the fixing device further comprising an overheat preventing element that is provided in a vicinity of the detecting section and suppresses energization to the resistance heat generating element when temperature of the detecting section reaches a predetermined value.

14. A fixing device comprising:

a first fixing member;

a heating member;

a fixing belt that forms an endless-shaped belt member supported around the first fixing member and the heating member with tension to be rotatable, and comes into contact with the heating member to be heated; and a second fixing member that forms a fixing nip region together with the fixing belt, the fixing device fixing a toner image borne on a recording medium onto the recording medium in the fixing nip region under application of heat and pressure, the heating member including:

a curved heat radiating member having an outer circumferential surface in contact with the fixing belt; and a heat generating member having a heat generating layer composed of a resistance heat generating element that generates heat due to being energized and arranged to be in contact with an inside surface of the heat radiating member, the resistance heat generating element including:

a paper passing region heating section forming a heat generating source part for heating a paper passing region of the fixing belt where the recording medium contacts and passes in the fixing nip region; and a detecting section that is provided to correspond to a paper non-contacting region of the recording medium of the fixing belt and connected electrically in parallel with the paper passing region heating section, the paper passing region heating section and the detecting section having an equivalent specific heat capacity, and the fixing device further comprising an overheat preventing element that is provided in a vicinity of the detecting section and suppresses energization to the resistance heat generating element when temperature of the detecting section reaches a predetermined value.

15. A fixing device comprising:

a first fixing member;

a heating member;

a fixing belt that forms an endless-shaped belt member supported around the first fixing member and the heating member with tension to be rotatable, and comes into contact with the heating member to be heated; and a second fixing member that forms a fixing nip region together with the fixing belt, the fixing device fixing a toner image borne on a recording medium onto the recording medium in the fixing nip region under application of heat and pressure, the heating member including:

a curved heat radiating member having an outer circumferential surface in contact with the fixing belt; and a heat generating member having a heat generating layer composed of a resistance heat generating element that generates heat due to being energized and arranged to be in contact with an inside surface of the heat radiating member, the resistance heat generating element including:

a paper passing region heating section forming a heat generating source part for heating a paper passing region of the fixing belt where the recording medium contacts and passes in the fixing nip region; and a detecting section that is provided to correspond to a paper non-contacting region of the recording medium of the fixing belt and connected electrically in parallel with the paper passing region heating section, the heat generating member having a heat generating layer composed of a plurality of the resistance heat generating elements, and being configured such that a heat generating part that generates heat due to being energized is divided into more than one, each of the plurality of resistance heat generating elements has having the paper passing region heating section and the detecting section, and the fixing device further comprising an overheat preventing element that is provided in a vicinity of the detecting section and suppresses energization to the resistance heat generating element when temperature of the detecting section reaches a predetermined value.

* * * * *